US011478912B2

(12) United States Patent
Yang et al.

(10) Patent No.: US 11,478,912 B2
(45) Date of Patent: Oct. 25, 2022

(54) NAIL GUN WHICH FIRES NAILS STABLY

(71) Applicant: Zhejiang Prulde Electric Appliance Co., Ltd., Zhejiang (CN)

(72) Inventors: Weiming Yang, Zhejiang (CN); Ting Han, Zhejiang (CN)

(73) Assignee: Zhejiang Prulde Electric Appliance Co., Ltd., Zhejiang (CN)

( * ) Notice: Subject to any disclaimer, the term of this patent is extended or adjusted under 35 U.S.C. 154(b) by 188 days.

(21) Appl. No.: 16/716,516

(22) Filed: Dec. 17, 2019

(65) Prior Publication Data

US 2020/0189081 A1 Jun. 18, 2020

(30) Foreign Application Priority Data

Dec. 17, 2018 (CN) ..... 201811542453.1

(51) Int. Cl.
*B25C 1/04* (2006.01)
*B25C 1/00* (2006.01)
*B25C 1/06* (2006.01)

(52) U.S. Cl.
CPC ..... *B25C 1/047* (2013.01); *B25C 1/008* (2013.01); *B25C 1/06* (2013.01)

(58) Field of Classification Search
CPC ..... B25C 1/046; B25C 1/06; B25C 1/008; B25C 1/047
See application file for complete search history.

(56) References Cited

U.S. PATENT DOCUMENTS

| | | | |
|---|---|---|---|
| 7,318,546 | B2 | 1/2008 | Segura et al. |
| 7,422,134 | B2 | 9/2008 | Aguirre et al. |
| 7,909,217 | B2 | 3/2011 | Aguirre et al. |
| 8,556,148 | B2 | 10/2013 | Schell et al. |

(Continued)

FOREIGN PATENT DOCUMENTS

| | | |
|---|---|---|
| CN | 100519089 | 7/2009 |
| CN | 202208001 | 5/2012 |

(Continued)

OTHER PUBLICATIONS

"Search Report of China Counterpart Application", dated May 27, 2021, p. 1-p. 2.
"Search Report of Europe Counterpart Application", dated May 27, 2020, p. 1-p. 7.

*Primary Examiner* — Anna K Kinsaul
*Assistant Examiner* — Himchan Song
(74) *Attorney, Agent, or Firm* — JCIP Global Inc.

(57) ABSTRACT

Disclosed is nail gun which fires nails stably, including: a housing, a trigger, an electric motor, a first cylinder, a second cylinder, a crank, a linkage, a nail firing assembly, and a nail supplying assembly, the second cylinder being disposed in the first cylinder, inside the first cylinder being provided a first piston, inside the second cylinder being provided a second piston, the linkage being in transmission connection with the first piston, the electric motor being in transmission connection with the crank via a transmission mechanism and driving, via the linkage, the first piston to make an axial motion in the first cylinder, a circulating air channel being provided between the first cylinder and the second cylinder, the nail firing assembly including a striker which is connected with the second piston.

17 Claims, 16 Drawing Sheets

(56) References Cited

U.S. PATENT DOCUMENTS

| | | | | |
|---|---|---|---|---|
| 8,800,834 | B2 | 8/2014 | Pedicini et al. | |
| 8,939,341 | B2 | 1/2015 | Pedicini et al. | |
| 9,555,530 | B2 | 1/2017 | Pedicini et al. | |
| 9,636,812 | B2 | 5/2017 | Pedicini | |
| 2005/0218178 | A1* | 10/2005 | Berry | B25C 1/06 227/8 |
| 2008/0190988 | A1 | 8/2008 | Pedicini et al. | |
| 2010/0213235 | A1 | 8/2010 | Pedicini et al. | |
| 2012/0286014 | A1 | 11/2012 | Pedicini et al. | |
| 2015/0122868 | A1* | 5/2015 | Campbell | B25C 1/047 227/130 |
| 2018/0043518 | A1 | 2/2018 | Fukinuki et al. | |
| 2018/0222028 | A1 | 8/2018 | Zhang | |
| 2021/0229249 | A1* | 7/2021 | Ootsuka | B25C 1/043 |

FOREIGN PATENT DOCUMENTS

| | | |
|---|---|---|
| CN | 203945333 | 11/2014 |
| CN | 102069474 | 8/2015 |
| CN | 102642193 | 4/2016 |
| CN | 206263884 | 6/2017 |
| CN | 105339137 | 9/2017 |
| CN | 206614481 | 11/2017 |
| CN | 206690016 | 12/2017 |
| CN | 206780321 | 12/2017 |
| CN | 207387570 | 5/2018 |
| CN | 108527255 | 9/2018 |
| JP | 4569037 | 10/2010 |
| TW | I335260 | 1/2011 |

* cited by examiner

NAIL GUN WHICH FIRES NAILS STABLY

CROSS-REFERENCE TO RELATED APPLICATION

This application claims the priority benefit of China application serial no. 201811542453.1, filed on Dec. 17, 2018. The entirety of the above-mentioned patent application is hereby incorporated by reference herein and made a part of this specification.

FIELD

Embodiments of the present disclosure relate to the field of power tools, and more particularly relate to a nail gun which fires nails stably.

BACKGROUND

A nail gun is a type of tool capable of rapidly driving nails into wood or some other kind of material, which is commonly used in carpentry. Among all, air-powered nail guns are of a common type. A conventional air-powered nail gun is generally connected, via a hose, to an external compressed air source with a certain pressure, which external compressed air source provides power to push a striker to move. That is to say, conventional air-powered nail guns require cooperation from an additional set of high-pressure air source generating equipment such as an air compressor, posing much inconvenience to use.

Currently, there has been provided a nail gun which may address that issue well, wherein a large cylinder and a small cylinder are provided and firing is done utilizing an impact brought by a pressure difference generated from the volume difference between the large and small cylinders. However, that nail gun still has some problems. For example, a magnet locking structure is utilized to retain the small piston in the small cylinder at a high level; when the small cylinder is subjected to enough high compressed air pressure, the small piston is relieved from locking to strike a nail via a striker. Although a nail gun of that structure offers a more convenience to use, magnetic field force discrepancy inherent in a magnet and manufacturing tolerances of relevant fittings would cause retention force discrepancy in the small piston, a consequence of which is that the impact force of each nail gun might vary, while the varying impact force would further cause an unstable pressure difference, which in turn causes an unstable nail firing.

SUMMARY

An object of the present disclosure is to provide a nail gun which fires nails stably.

To achieve the object above, the present disclosure provides the following technical solution: a nail gun which fires nails stably, including: a housing, a trigger, an electric motor, a first cylinder, a second cylinder, a crank, a linkage, a nail firing assembly, and a nail supplying assembly, the second cylinder being disposed in the first cylinder, inside the first cylinder being provided a first piston, inside the second cylinder being provided a second piston, the linkage being in transmission connection with the first piston, the electric motor being in transmission connection with the crank via a transmission mechanism and driving, via the linkage, the first piston to make an axial motion in the first cylinder, a circulating air channel being provided between the first cylinder and the second cylinder, the nail firing assembly including a striker which is connected with the second piston, wherein an upper end inside the first cylinder is provided with a lock catch assembly locking the second piston to a high point, an unlocking ejector pin is provided on the first piston, the first piston moves upwards to drive the unlocking ejector pin to move upwardly, such that the unlocking ejector pin pushes the lock catch assembly to be detached from the second piston, and then the second piston moves downwardly under an air pressure to cause the striker to strike the nail.

Further, the second piston includes a piston core and a piston bush sleeved on the piston core, an upper end of the piston core is provided with a bayonet fitted with the lock catch assembly.

Further, the upper end inside the first cylinder is provided with a mounting seat, and inside the mounting seat is provided a mounting slot, wherein the lock catch assembly is installed in the mounting slot; a notch for the unlocking ejector pin to extend into is provided at a bottom portion of the mounting seat, and the unlocking ejector pin penetrates through the notch to act in cooperation with the lock catch assembly.

Further, the lock catch assembly includes a lock catch and a lock catch elastic element which pushes the lock catch to reset, a limiting step fitted with the bayonet and an open slot in communication with the notch are provided on the lock catch, and a push bevel fitted with the unlocking ejector pin is provided at an inner side wall of a lower end of the open slot.

Further, a mounting hole is provided inside a rear end of the lock catch, wherein one end of the lock catch elastic element is mounted in the mounting hole, and the other end thereof abuts against an inner wall of the mounting seat.

Further, a guide rail is provided in the mounting slot, wherein a profile of the guide rail is arranged to match that of the mounting slot; the guide rail is provided with a slideway, wherein the lock catch assembly is disposed in the slideway; and a bottom wall of the guide rail is provided with a through port in communication with the notch.

Further, an upper end of the piston core projects out of a top wall of the second cylinder; a guide bush is provided between the upper end of the piston core and the top wall of the second cylinder; an upper end of the guide bush penetrates through the mounting seat and a top wall of the first cylinder; and an upper end periphery of the guide bush is provided with an external thread and is fixed, via a nut, onto a top wall of the first cylinder.

Further, an upper end side wall of the guide bush is provided with a side opening for the lock catch assembly to penetrate through so as to act in cooperation with the bayonet.

Further, a lower end of the guide bush is provided with an annular step fitted with a top wall inner surface of the second cylinder, wherein a first sealing ring is provided between the annular step and the top wall inner surface of the second cylinder.

Further, the nail gun includes a trigger switch; a trigger ejector pin which can trigger the trigger switch upon trigger-pulling is provided on the trigger; the transmission mechanism includes a decelerator, a transmission shaft in transmission connection with the decelerator, and a cam sleeved on the transmission shaft; and a self-lock ejector pin is provided between the cam and the trigger switch, such that when the cam moves to the high point, it pushes the self-lock ejector pin to trigger the trigger switch and detach the trigger ejector pin from the trigger switch; while when the cam moves to a low point, the self-lock ejector pin is detached from the trigger switch.

Further, the trigger is provided with a rotary shaft, and the trigger ejector pin is provided with a rotary hole, such that the trigger ejector pin is sleeved, via the rotary hole, on the rotary shaft so as to cause the trigger ejector pin to motion with the trigger to trigger the trigger switch.

Further, a torsional spring causing the trigger ejector pin to deflect is further sleeved on the rotary shaft; a snap groove is provided on the trigger ejector pin; one end of the torsional spring is clamped in the snap groove of the trigger ejector pin, and the other end thereof abuts against a stop of the trigger.

Further, a bump is provided on the cam, such that when the cam moves to the high point, the bump contact-actuates a lower end of the trigger ejector pin to cause the trigger ejector pin to be deflected and detached from the trigger switch.

Further, the lower end of the trigger ejector pin is provided with a guide bevel which facilitates the bump to contact-actuate the trigger ejector pin.

Further, the bump is disposed at one side of the cam proximal to the decelerator, the bump and the cam being of an integral structure.

Further, a lower end of the self-lock ejector pin is provided with a fitting portion fitted with the cam, the fitting portion having a big-end-down trapezoidal shape.

Further, the nail gun further includes an MCU (Microcontroller Unit) and a selector switch that may freely switch the nail gun between a single nail mode or a continuous nail mode, the selector switch being electrically connected to the MCU.

Further, the nail firing assembly further includes a fixed seat, a nail exit base plate and a nail exit cover plate, wherein a lower end of the nail firing assembly is provided with a muzzle; a gain gun further includes a safety ejector pin assembly provided at the fixed seat side, wherein the safety ejector pin assembly includes a safety switch and a safety ejector pin; the nail supplying assembly includes a guide rail plate, a movable guide rail fitted with the guide rail plate, a nail supplying block which presses against the nail, and a nail supplying elastic element for resetting the nail supplying block being provided between the movable guide rail and the nail supplying block; on the nail exit base plate is provided a dry fire proof ejector pin; on the nail exit base plate is further provided a pin shaft penetrating through the dry file proof ejector pin; between the dry fire proof ejector pin and the nail supplying elastic element is provided an ejector block; when there exist no nails inside the nail supplying assembly, the nail supplying elastic element may presses against the ejector block, such that the ejector block presses against the dry fire proof ejector pin to axially limit the safety ejector pin to thereby prevent the safety ejector pin from contact-actuating the safety switch.

Further, on the movable guide rail is provided an accommodation groove for mounting the nail supplying elastic element; a front end of the nail supplying elastic element is provided with an elastic element ejector block; the elastic element ejector block is disposed within the accommodation groove; the ejector block is movably disposed in the accommodation groove and provided at a front end of the elastic element ejector block; a front end of the accommodation groove is provided with a limiting pin for limiting the ejector block; the ejector block includes a body, and a first push portion and a second push portion which are arranged in stagger, wherein the first push portion acts in cooperation with the dry fire proof ejector pin, and the second push portion acts in cooperation with the elastic element ejector block.

Further, the safety ejector pin assembly further includes: a bushing support fixed on the fixed seat, a movable inner tube movably provided in the bushing support, and a connecting rod in connection with the movable inner tube; wherein the connecting rod is connected to the safety ejector pin; an upper end of the movable inner tube is provided with a contact-actuating frame that triggers the safety switch and moves along with the movable inner tube; the safety ejector pin may move continuously along an axial direction of the movable inner tube so as to adjust an axial distance between a bottom end of the safety ejector pin and the muzzle.

In the present disclosure, the feature "when the cam moves to a high point" means the first/second piston moves to an upper limit position, and the feature "when the cam moves to a low point" means that the first/second piston moves to a lower limit position.

After adopting the technical solution above, the present disclosure has the following advantages:

1. In the present disclosure, by providing, at an upper end in the first cylinder, a lock catch assembly which locks the second piston to a high point, and by providing an unlocking ejector pin on the first piston, upward movement of the first piston drives the unlocking ejector pin to move upwardly; the unlocking ejector pin pushes the lock catch assembly to be detached from the second piston; under air pressure, the second piston moves downwardly to cause the striker to strike the nail. With the mechanical lock catch structure, pressure is maintained against locking of the second piston, which is more reliable and stable compared with a conventional magnetic locking manner with magnetic elements, such that individual discrepancies among magnetic elements would not cause instability or nonuniform of magnetic forces; the unstable or nonuniform magnetic forces would further cause nail firing under insufficient pressure against the second piston, which would affect the final nailing effect. In other words, the manner of locking and pressurizing the second piston by the lock catch assembly may well guarantee a nailing effect; the unstable factors inherent in the parts would not affect the nailing effect, such that nailing stability and nailing effect of the nail gun are guaranteed. Meanwhile, the lock catch assembly offers a reliable locking and an ease of detaching from the second piston. Further, the lock catch assembly has a simple structure such that it is easily manufactured.

2. The second piston includes a piston core and a piston bush sleeved on the piston core; an upper end of the piston core is provided with a bayonet fitted with the lock catch assembly; the bayonet on the piston core is fitted with the lock catch assembly to maintain pressure against locking to the second piston; in this way, it is convenient for the lock catch assembly to lock the second piston, and when the second piston is released, it is easy to be detached from the lock catch assembly, thereby guaranteeing nailing effect and nailing stability.

3. A mounting seat is provided at the upper end inside the first cylinder; a mounting slot is provided inside the mounting seat; the lock catch assembly is mounted in the mounting slot; a notch for the unlocking ejector pin to extend into is provided at a bottom portion of the mounting seat; and the unlocking ejector pin penetrates through the notch to act in cooperation with the lock catch assembly. The mounting seat and the mounting slot not only facilitate mounting and fixing the lock catch assembly, but also facilitate the unlocking ejector pin to contact-actuate the lock catch assembly when the first piston moves to the high point, thereby guaranteeing that the second piston may be well released and further guaranteeing a no-delay, accurate, and efficient nailing.

4. The lock catch assembly includes a lock catch and a lock catch elastic element configured for pushing the lock catch to reset; on the lock catch are provided a limiting step fitted with the bayonet and an open slot in communication with the notch; a pushing bevel fitted with the unlocking ejector pin is provided at an inner sidewall of the lower end of the open slot. The lock catch elastic element enables the lock catch, after being detached from the second piston, to be reset to the initial position; after the second piston is reset, it is locked by the lock catch again, ready for a next nailing action. In this way, working continuity of the nail gun is guaranteed, and working efficiency of the nail gun is enhanced. Meanwhile, when the second piston is locked by the lock catch, the elastic force of the lock catch elastic element may well guarantee the locking force with respect to the second piston, i.e., guaranteeing that the second piston is not easily loosened, wherein only under enough pressure force and under contact actuation from the unlocking ejector pin, can the second piston be detached. Moreover, arrangement of the open slot and the pushing bevel facilitates the unlocking ejector pin to contact-actuate the lock catch so as to guarantee that the lock catch can be accurately detached from the second piston to thereby release the second piston to perform nail shooting.

5. A mounting hole is provided inside the rear end of the lock catch; one end of the lock catch elastic element is mounted in the mounting hole, while the other end thereof abuts against the inner wall of the mounting seat; arrangement of the mounting hole facilitates limiting the lock catch elastic element to prevent the lock catch elastic element from being deflected from a radial direction, thereby guaranteeing working reliability of the lock catch elastic element, i.e., enabling the lock catch elastic element to push the lock catch stably and reliably.

6. A guide rail is provided in the mounting slot, wherein a profile of the guide rail is arranged to match a profile of the mounting slot; the guide rail is provided with a slideway, wherein the lock catch assembly is disposed in the slideway; and a bottom wall of the guide rail is provided with a through port in communication with the notch. As such, the friction between the lock catch and the mounting slot and the friction between the lock catch elastic element and the mounting slot may be reduced; besides, motion of the lock catch and the lock catch elastic element may be well guided to guarantee the overall working reliability and stability of the lock catch assembly.

7. An upper end of the piston core projects out of a top wall of the second cylinder; a guide bush is provided between the upper end of the piston core and the top wall of the second cylinder; an upper end of the guide bush penetrates through the mounting seat and the top wall of the first cylinder; and an upper end periphery of the guide bush is provided with an external thread and is fixed, via a nut, onto the top wall of the first cylinder. Arrangement of the guide bush facilitates fixing the second cylinder and the mounting seat and meanwhile facilitates communication between the second cylinder and the first cylinder to guarantee enough pressure against the second piston, thereby guaranteeing nailing stability and nailing effect.

8. An upper end side wall of the guide bush is provided with a side opening for the lock catch assembly to penetrate through so as to act in cooperation with the bayonet, which facilitates connection between the lock catch assembly and the piston core; moreover, the connection is reliable and stable; further, structural design becomes easier.

9. A lower end of the guide bush is provided with an annular step fitted with a top wall inner surface of the second cylinder, wherein a first sealing ring is provided between the annular step and the top wall inner surface of the second cylinder, which enhances sealing at the joint between the guide bush and the second cylinder and guarantees no air leakage, thereby guaranteeing enough pressure force against the second piston, guaranteeing enough striking force from the striker, and further guaranteeing the nailing effect.

10. The nail gun is provided with a trigger switch, and a trigger ejector pin is arranged on the trigger. After the trigger is pulled, the trigger switch may be triggered; then, the electric motor is energized to rotate to drive, via the transmission mechanism, the crank to motion, and then drives, via the linkage, the first piston to move axially in the first cylinder. A circulating air channel is provided between the first cylinder and the second cylinder. The first piston motions to compress the air in the first cylinder; the compressed air is conveyed to the second cylinder via the circulating air channel. As the compressed air applies enough air pressure against the second piston; the second piston is released and rapidly moves downwardly under this air pressure to cause the striker to strike the nail. The transmission mechanism specifically includes a decelerator, a transmission shaft in transmission connection with the decelerator, and a cam sleeved on the transmission shaft. A self-lock ejector pin is provided between the cam and the trigger switch, such that when the cam moves to a high point, it pushes the self-lock ejector pin to trigger the trigger switch and drives the trigger ejector pin to be detached from the trigger switch. That is, the self-lock ejector pin presses against the trigger switch to ensure that the trigger switch is not open, thereby guaranteeing continuous motion of the electric motor, which further ensures that the nailing process is not interrupted. The cam continues moving, and when the cam moves to a low point, the self-lock ejector pin is detached from the trigger switch, then the trigger switch is open to interrupt the power supply of the electric motor, and then the electric motor stops working, thereby finishing one action cycle of the nail gun. This manner of controlling the electric motor to finish an action cycle with a mechanical structure is more stable and reliable compared with conventional controlling through detection by a position sensor, thereby ensuring nailing reliability, i.e., guaranteeing working reliability of the nail gun.

11. A rotary shaft is provided on the trigger, a rotary hole is provided on the trigger ejector pin, and the trigger ejector pin is sleeved on the rotary shaft via the rotary hole. As such, the trigger ejector pin may motion with the trigger to trigger the trigger switch. This structure is not only simple and reliable, but also offers stable working to ensure the reliability of triggering the triggering switch, thereby further ensuring operating reliability of the electric motor and nailing reliability of the nail gun.

12. On the rotary shaft is further sleeved a torsional spring which may deflect the trigger ejector pin; a snap groove is provided on the trigger ejector pin; one end of the torsional spring is clamped into the snap groove of the trigger ejector pin, while the other end thereof abuts against a stop block of the trigger. As such, the trigger ejector pin generates a certain torsional force via the torsional spring, which facilitate the trigger ejector pin to maintain a working state, i.e., maintaining a good trigger position state when it is needed to trigger the trigger switch, while maintaining a good detached position state when it is needed to detach from the trigger switch, thereby enhancing working reliability and stability of the trigger ejector pin, such that the trigger ejector pin would not be affected by other external forces.

13. A bump is provided on the cam, such that when the cam moves to the high point, the bump may contact-actuate the lower end of the trigger ejector pin to cause the trigger ejector pin to be deflected and detached from the trigger switch to open the trigger switch, thereby guaranteeing the reliability of the cam in contact-actuating the trigger ejector pin.

14. A guide bevel facilitating the bump to contact-actuate the trigger ejector pin is provided at a lower end of the trigger ejector pin, which may well guarantee the reliability of the cam in contact-actuating the trigger ejector pin, i.e., easily actuating the trigger ejector pin to be defected, thereby facilitating triggering or detaching from the trigger switch.

15. By providing the bump at one side of the cam proximal to the decelerator, it facilitates the bump to avoid the self-lock ejector pin. Namely, when the cam is rotating, it does not contact the self-lock ejector pin, which guarantees action reliability of the trigger ejector pin; besides, by arranging the bump and the cam into an integral structure, i.e., machining them integrally, it facilitates manufacturing and machining of the bump and the cam; besides, the integral structure offers a good strength, durability, and long service life.

16. A lower end of the self-lock ejector pin is provided with a fitting portion fitted with the cam, wherein the fitting portion has a big-end-down trapezoidal shape, which enhances a contact area of fitting between the self-lock ejector pin and the cam, thereby facilitating reliable fitting between the self-lock ejector pin and the cam; besides, the reliable fitting guarantees action reliability of the self-lock ejector pin.

17. The nail gun further includes an MCU (Microcontroller Unit) and a selector switch that enables the nail gun to switch freely between a single nail mode or a continuous nail mode, the selector switch being electrically connected to the MCU; in this way, the nail gun may switch freely between the single nail mode and the continuous nail mode so as to meet different work requirements, thereby enhancing working efficiency of the nail gun.

18. By providing a safety ejector pin assembly and a dry fire proof ejector pin cooperating with the safety ejector pin assembly to prevent dry fire of the nail gun, use safety of the nail gun is enhanced. The safety ejector pin assembly includes a selector switch and a safety ejector pin; the nail supplying assembly includes a guide rail plate, a movable guide rail fitted with the guide rail plate, and a nail supplying block which presses against the nail; between the movable guide rail and the nail supplying block is provided a nail supplying elastic element for resetting the nail supplying block; the dry fire proof ejector pin is hinged to the pin shaft of the nail exit base plate; and an ejector block is provided between the dry fire proof ejector pin and the nail supplying elastic element. As such, when there exist no nails inside the nail supplying assembly, the nail supplying elastic element may presses against the ejector block which then pushes against the dry fire proof ejector pin to axially limit the safety ejector pin in the axial direction to thereby prevent telescoping of the safety ejector pin from contact-actuating a safety switch. In this case, the nail gun cannot perform a nailing operation, thereby guaranteeing use safety of the nail gun when the nails run out.

19. An accommodation groove for mounting the nail supplying elastic element is provided on the movable guide rail; a front end of the nail supplying elastic element is provided with an elastic element ejector block, wherein the elastic element ejector block is disposed in the accommodation groove. By arranging the nail supplying elastic element in the accommodation groove and with the elastic element ejector block pressing tightly the nail supplying elastic element into the accommodation cavity, the nail supplying elastic element is enabled to constantly maintain a compressed elastic force, which enables the nail supplying elastic element to constantly press against the nail supplying block. The nail supplying block presses against a nail to deliver it; in this way, it may well guarantee that the direction of pushing the nail supplying elastic element is not deflected, thereby guaranteeing stability of nail supplying. Meanwhile, where there exist no nails, the nail supplying elastic element pushes against the ejector block via the elastic element ejector block, causing the dry fire proof ejector pin to axially limit the safety ejector pin, thereby preventing telescoping of the safety ejector pin from contact-actuating the safety switch. Besides, the elastic element ejector block is in fit contact with the ejector block; the large contact area of fitting facilitates pressing against the ejector pin, which guarantees that the ejector block imposes an enough pushing force against the dry fire proof ejector pin and further guarantees that the dry fire proof ejector pin imposes a reliable axial limitation to the safety ejector pin. Second, by movably disposing the ejector block in the accommodation groove and at the front end of the elastic element ejector block, and by providing, at the front end of the accommodation groove, a limiting pin for limiting the ejector pin, it facilitates limiting the ejector block to prevent the ejector block from escaping, thereby guaranteeing the reliability and stability of the ejector pin in pushing the dry fire proof ejector pin. Further, the ejector block includes a body, and a first pushing portion and a second pushing portion which are disposed at two ends of the body and arranged in stagger, wherein the first pushing portion acts to cooperate with the dry fire proof ejector pin, and the second pushing portion acts to cooperate with the elastic element ejector pin. The cross-section of the ejector block has a stepped shape, such that the first pushing portion and the second pushing portion may not only work independently without mutual interference, but also may form a good limitation and fixation to the ejector block.

20. A safety ejector pin assembly is provided, wherein the safety ejector pin assembly includes a safety switch, a bushing support fixed on the fixed seat, a movable inner tube movably disposed in the bushing support, a connecting rod in connection with the movable inner tube, and a safety ejector pin in connection with the connecting rod. At an upper end of the movable inner tube are provided a trigger safety switch and a contact-actuating frame which is movable along with the movable inner tube, such that when the nail gun performs nailing, the trigger can only be pulled when the safety ejector pin is pressed to energize the safety switch, and then the electric motor rotates to start nailing. In other words, without pressing against the safety ejector pin, the trigger cannot be pulled to drive the electric motor to rotate, i.e., the nail gun cannot be energized to work, which enhances use safety of the nail gun. Meanwhile, a nailing depth is affected by the distance between the muzzle and a wood board. Specifically, the closer the distance from the muzzle is, the deeper the nail is driven into the wood board; the farther the distance between the muzzle and the wood board is, the shallower the nail is driven into the wood board. By configuring the safety ejector pin to be continuously movable along the axial direction of the movable inner tube so as to adjust the axial distance between the bottom end of the safety ejector pin and the muzzle (wherein change of the axial distance refers to change of the distance between the muzzle and the wood board, and adjusting the movable inner tube to adjust the axial distance between the bottom end of the safety ejector pin and the muzzle refers to adjusting the distance between the muzzle and the wood board), nailing depth becomes adjustable to ensure the nailing effect. That is, the axial distance between the bottom end of the safety ejector pin and the muzzle may be adjusted based on depths of different wood boards, thereby guaranteeing a good nailing effect and further enhancing the adaptability of the nail gun, i.e., enabling the nail gun to nail wood boards of different depths.

BRIEF DESCRIPTION OF THE DRAWINGS

Hereinafter, the present disclosure will be described in further detail with reference to the accompanying drawings.

DETAILED DESCRIPTION OF EMBODIMENTS

Hereinafter, the present disclosure will be described in further detail with reference to the accompanying drawings and the embodiments. It needs to be understood that the oriental or positional relationships indicated by the terms "upper," "lower," "left," "right," "longitudinal," "transverse," "inner," "outer," "vertical," "horizontal," "top," "bottom," etc. are oriental and positional relationships only based on the drawings, which are intended only for facilitating or simplifying description of the present disclosure, not for indicating or implying that the devices/elements have to possess those specific orientations or have to be configured and operated with those specific orientations; therefore, they should not be understood as limitations to the present disclosure.

Figure 1:
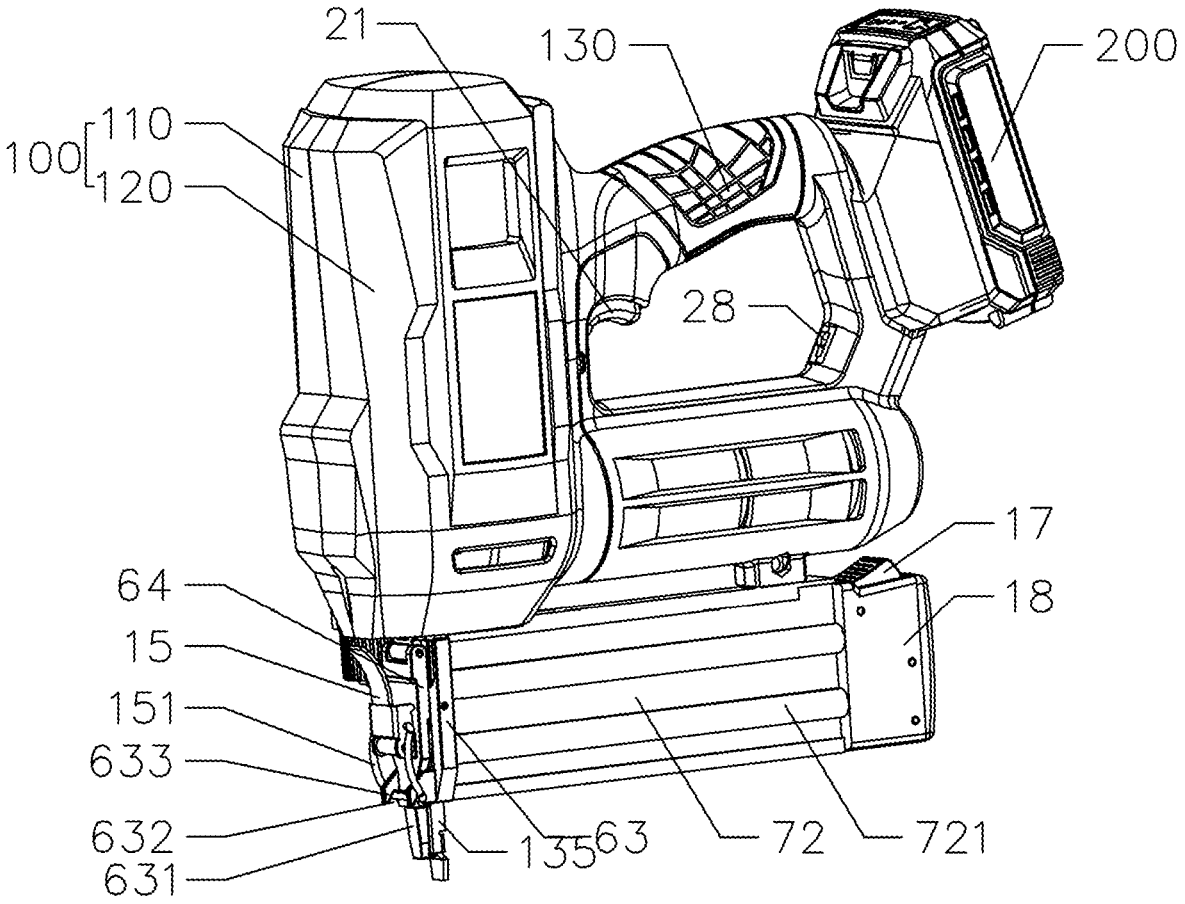
FIG. 1 is a structural schematic diagram of a nail gun according to the present disclosure.
Figure 2:
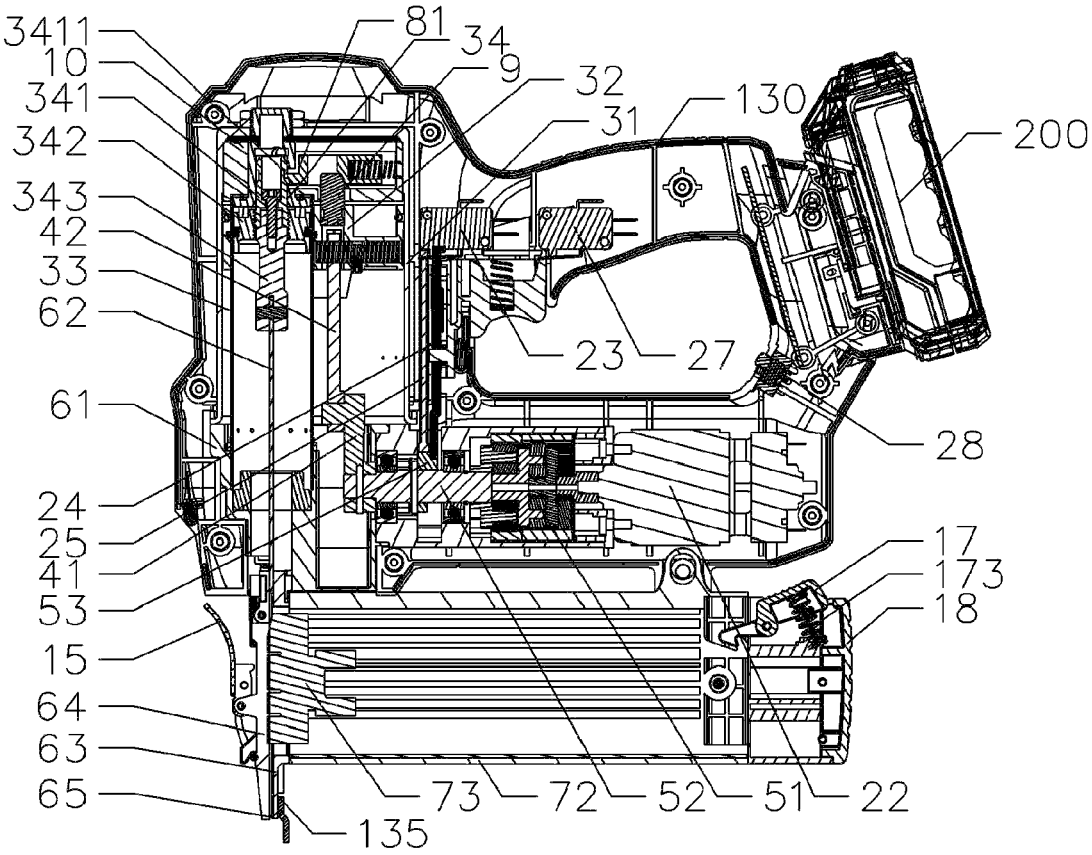
FIG. 2 is a sectional view of the nail gun according to the present disclosure.
Figure 3:
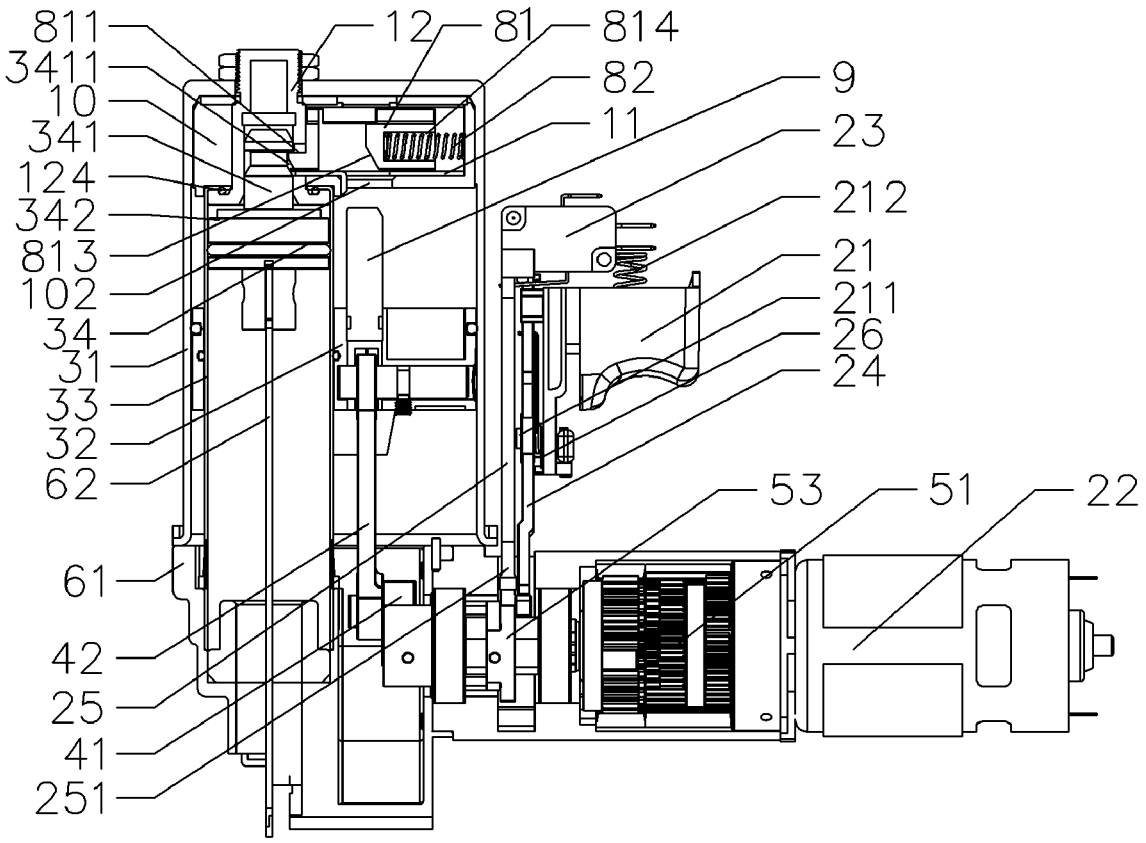
FIG. 3 is a local structural schematic diagram of the nail gun according to the present disclosure.
Figure 4:
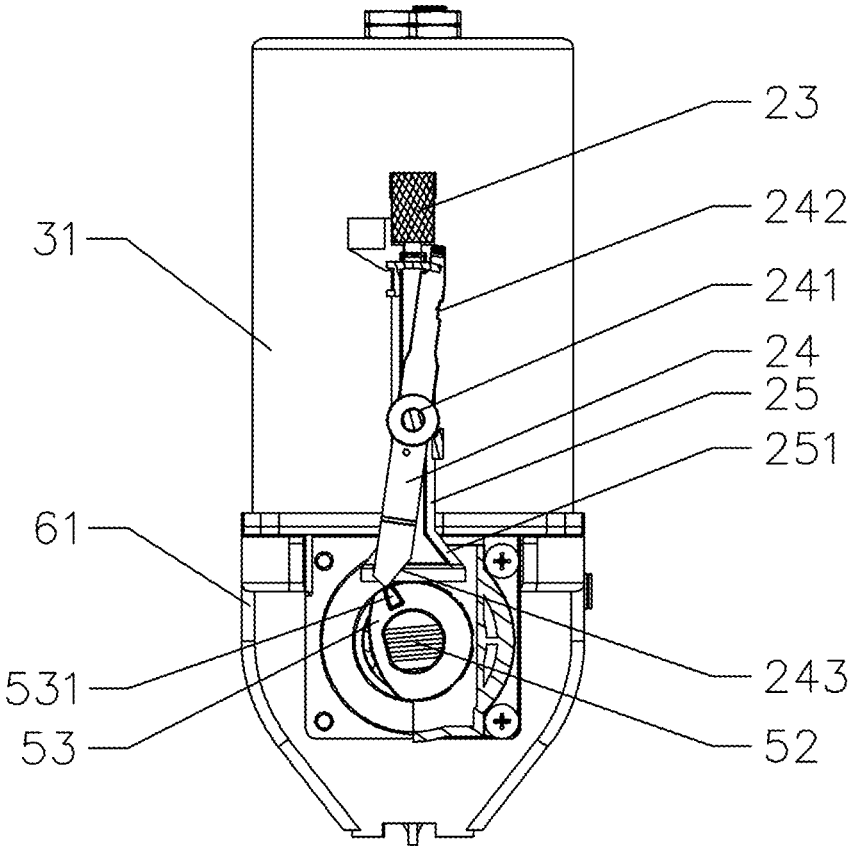
FIG. 4 is another local structural schematic diagram of the nail gun according to the present disclosure.
Figure 5:
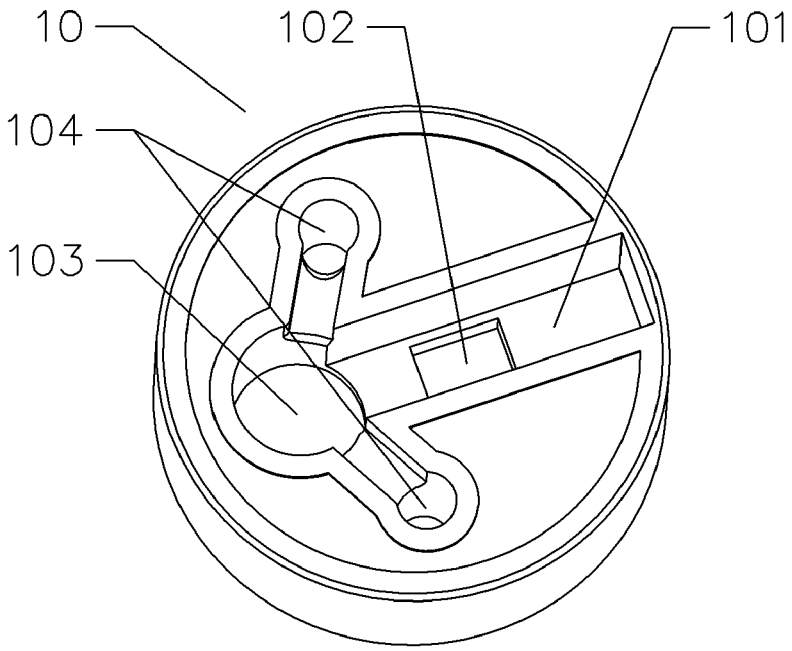
FIG. 5 is a structural schematic diagram of a mounting seat in the nail gun according to the present disclosure.
Figure 6:
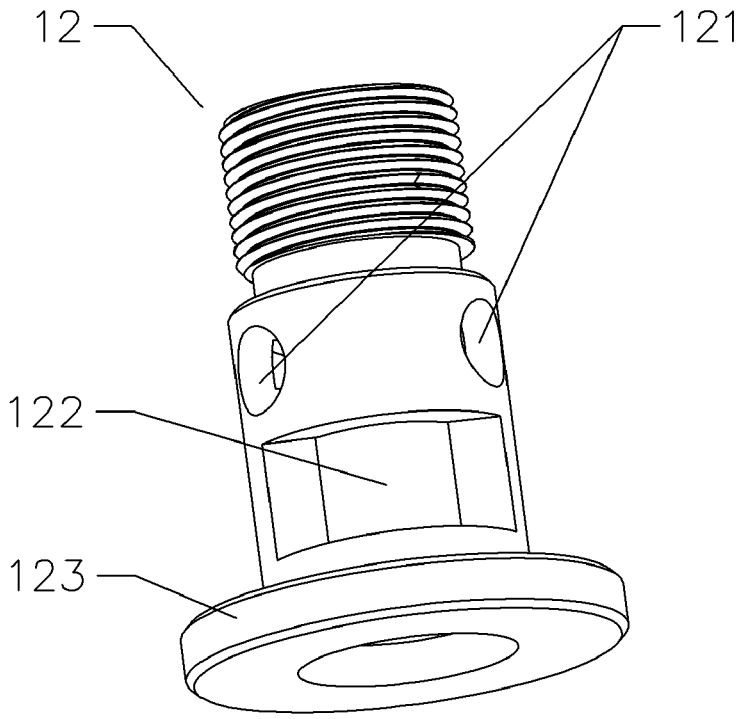
FIG. 6 is a structural schematic diagram of a guide bush in the nail gun according to the present disclosure.
Figure 7:
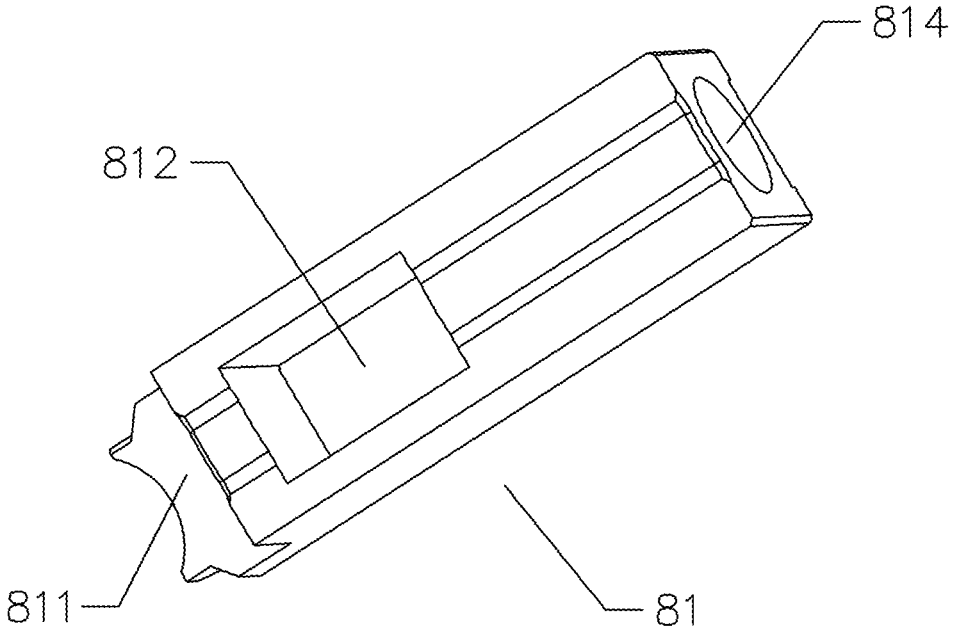
FIG. 7 is a structural schematic diagram of a lock catch in the nail gun according to the present disclosure.
Figure 8:
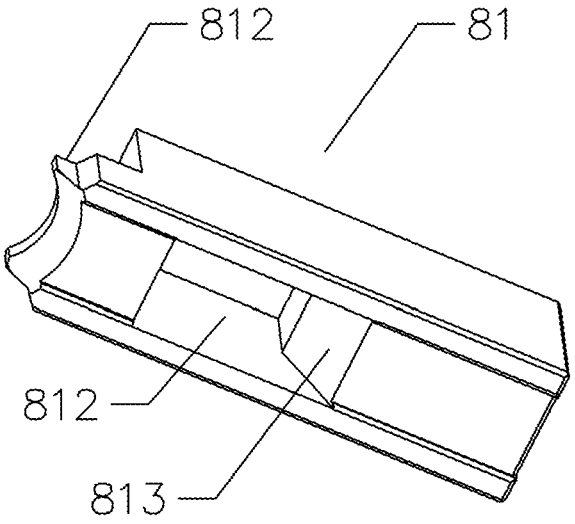
FIG. 8 is a structural schematic diagram from another perspective of the lock catch in the nail gun according to the present disclosure.
Figure 9:
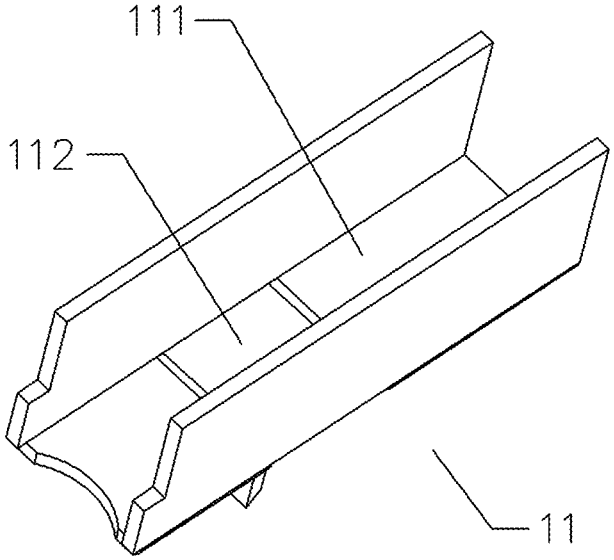
FIG. 9 is a structural schematic diagram of a guide rail in the nail gun according to the present disclosure.
Figure 10:
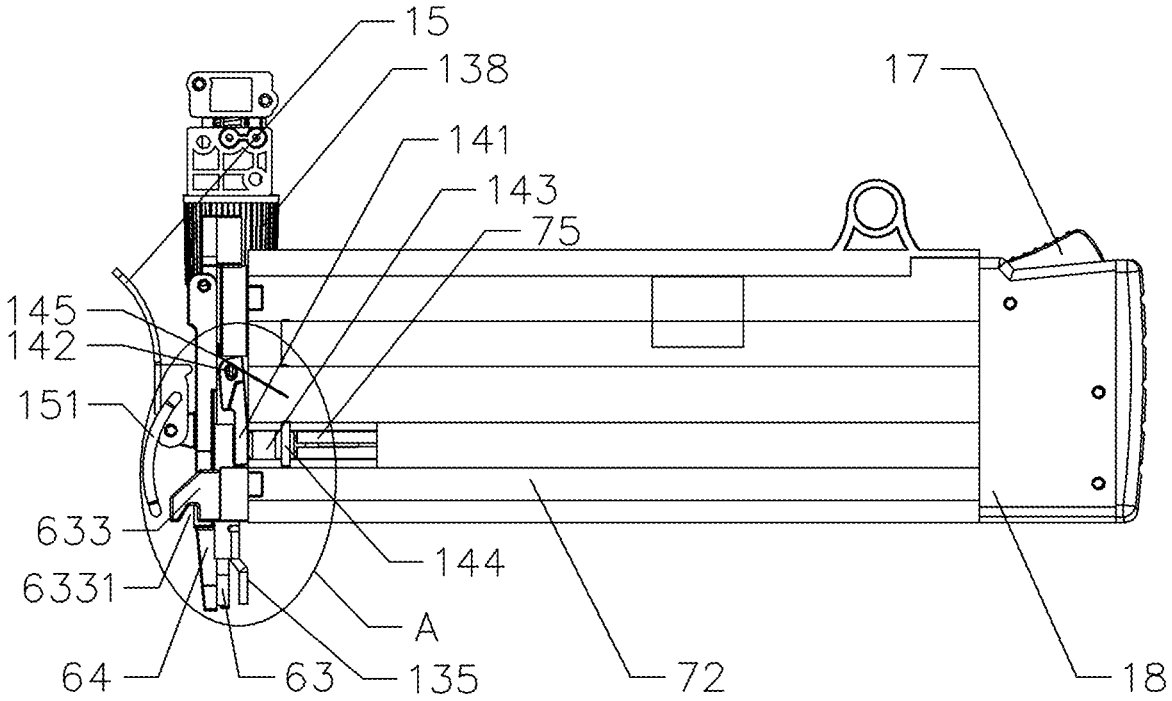
FIG. 10 is a schematic diagram of an action of a dry fire proof ejector pin when there exist no nails in the nail gun according to the present disclosure.
Figure 11:
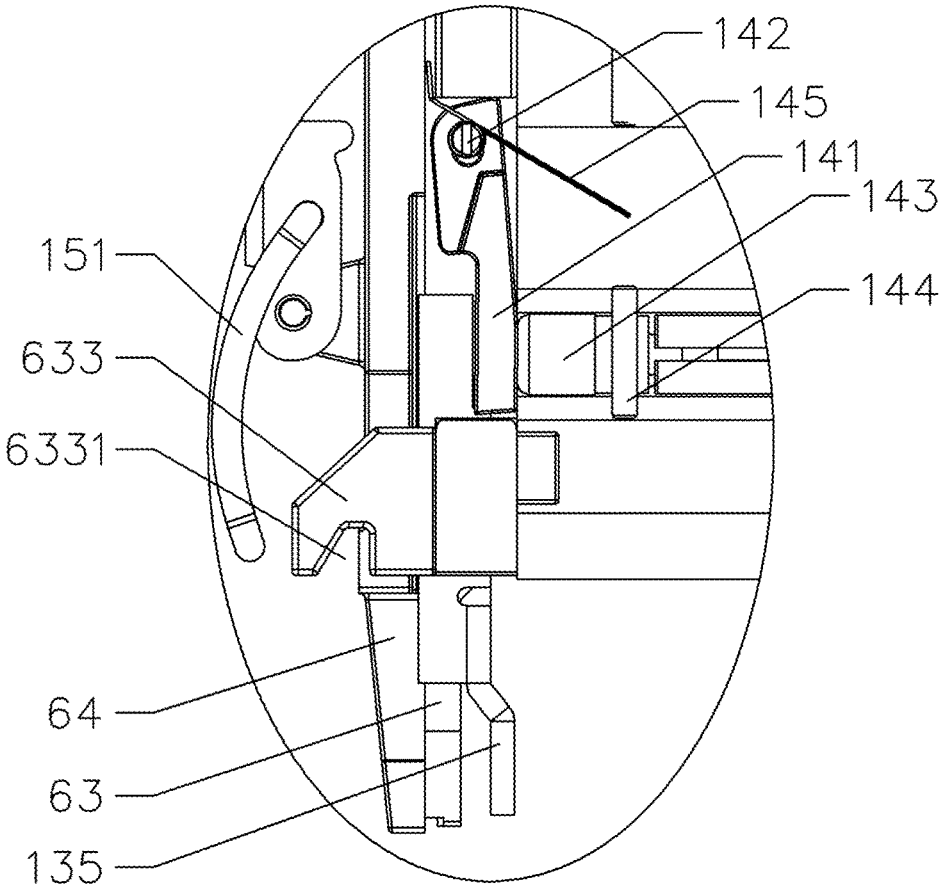
FIG. 11 is an enlarged view of A in FIG. 10.
Figure 12:
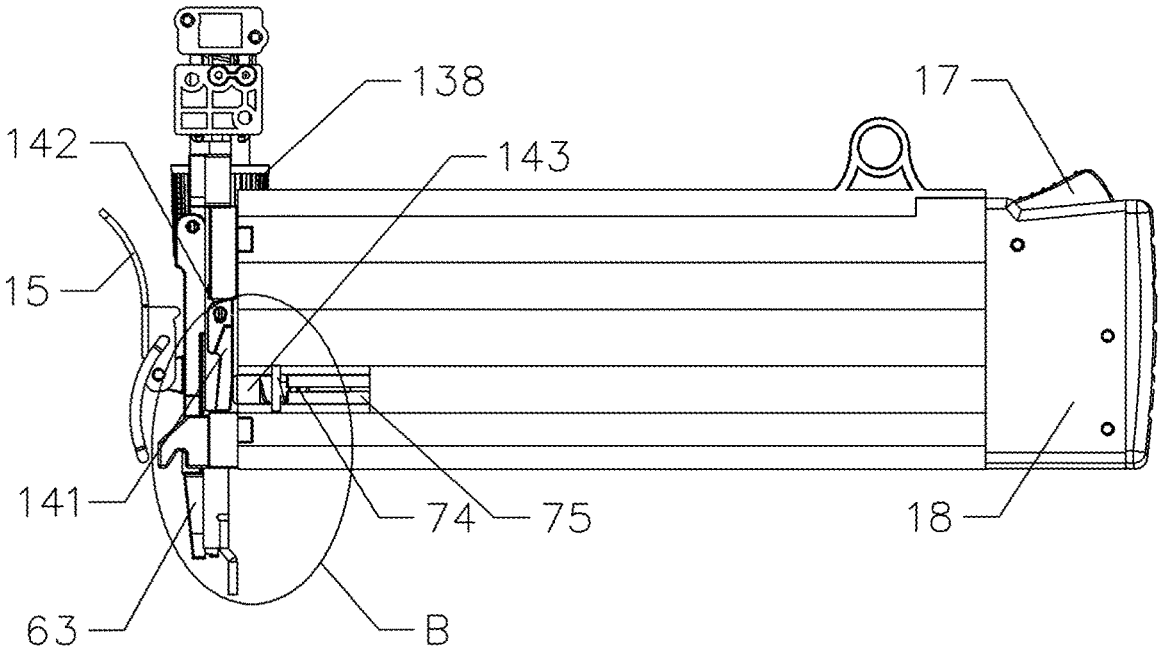
FIG. 12 is a schematic diagram of an action of a dry fire proof ejector pin when there exist nails in the nail gun according to the present disclosure.
Figure 13:
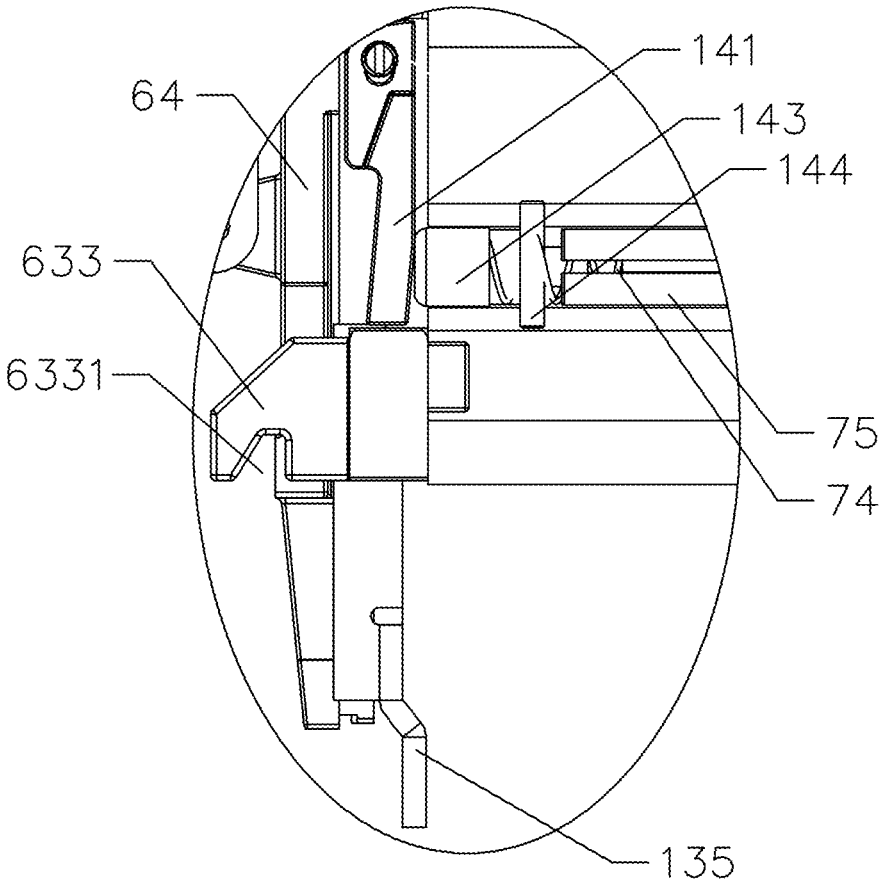
FIG. 13 is an enlarged view of B in FIG. 12.
Figure 14:
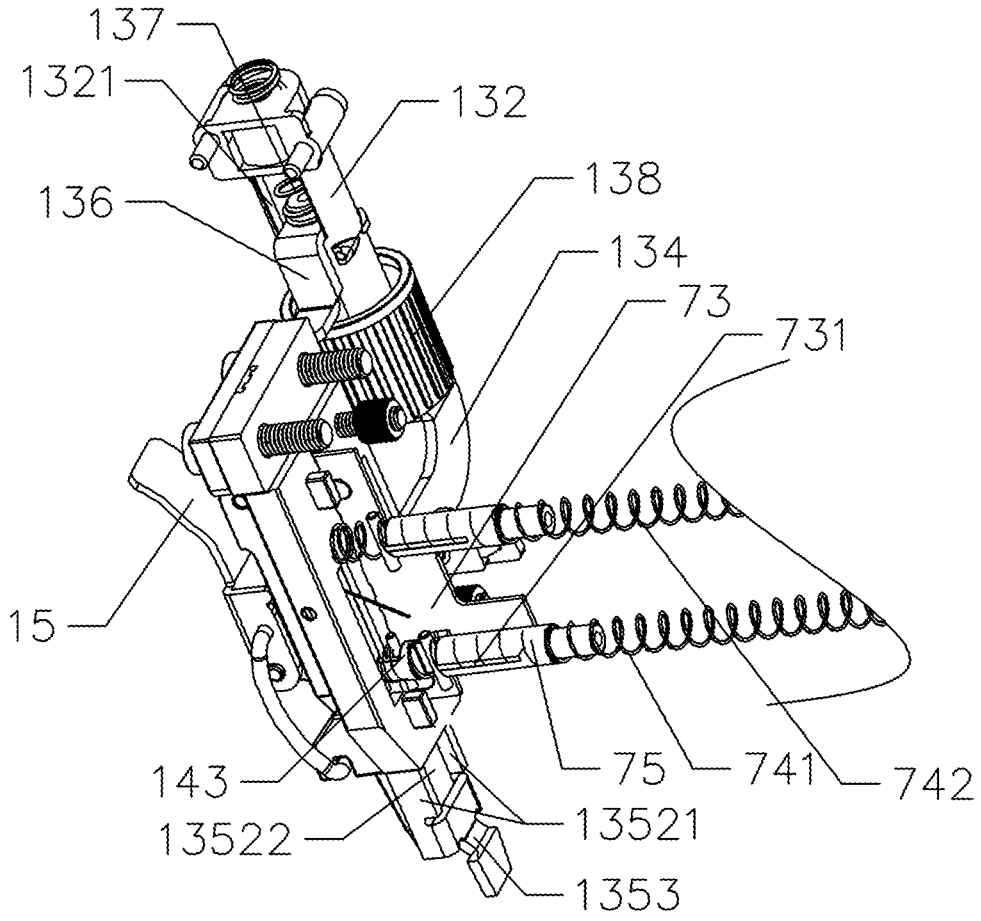
FIG. 14 is a local fitting structural schematic diagram between a nail firing assembly and a nail supplying assembly in the nail gun according to the present disclosure.
Figure 15:
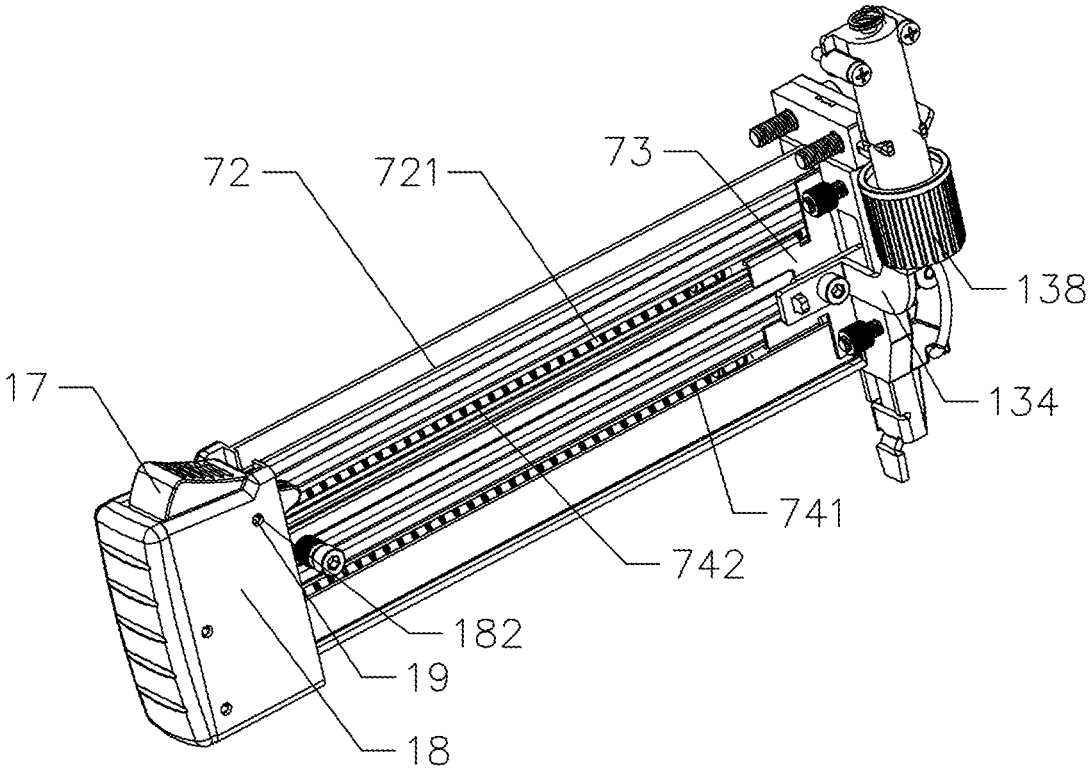
FIG. 15 is a local structural schematic diagram of the nail supplying assembly in the nail gun according to the present disclosure.
Figure 16:
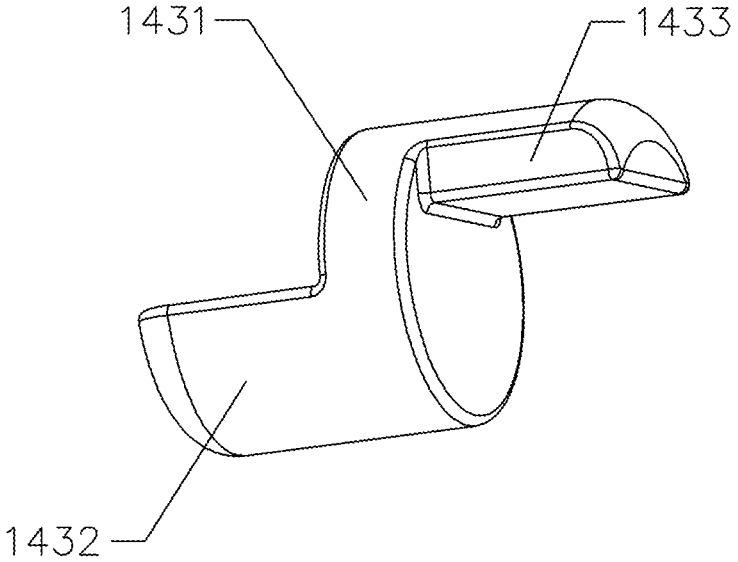
FIG. 16 is a structural schematic diagram of an ejector block in the nail gun according to the present disclosure.
Figure 17:
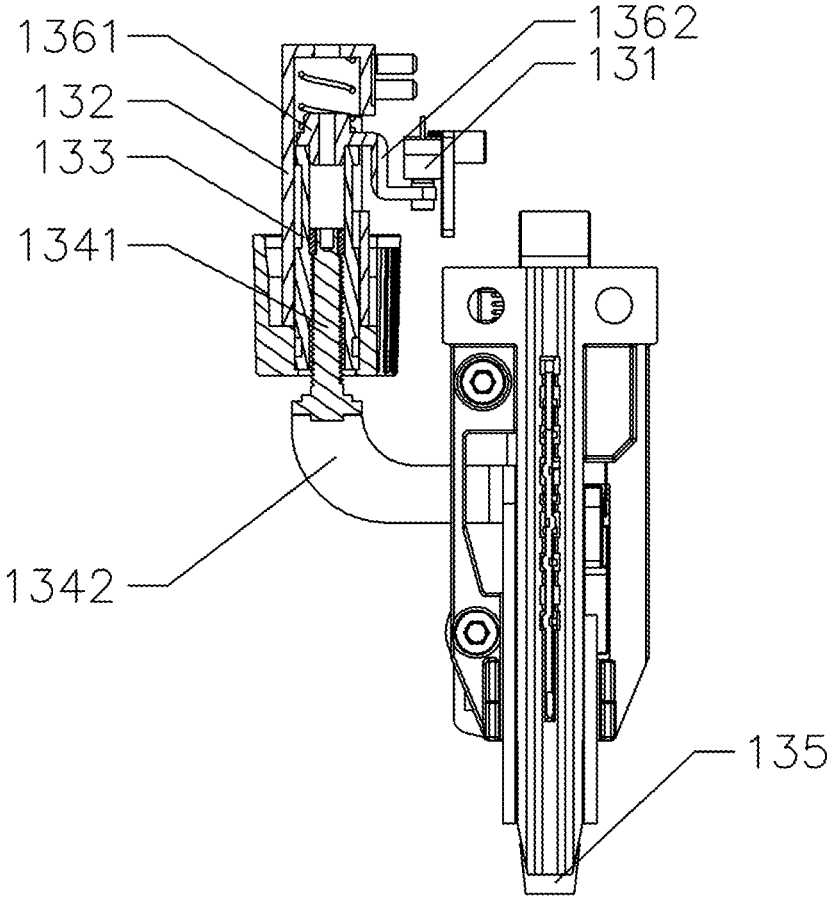
FIG. 17 is a local sectional view of fitting between a safety ejector pin assembly and a nail supplying assembly in the nail gun according to the present disclosure.
Figure 18:
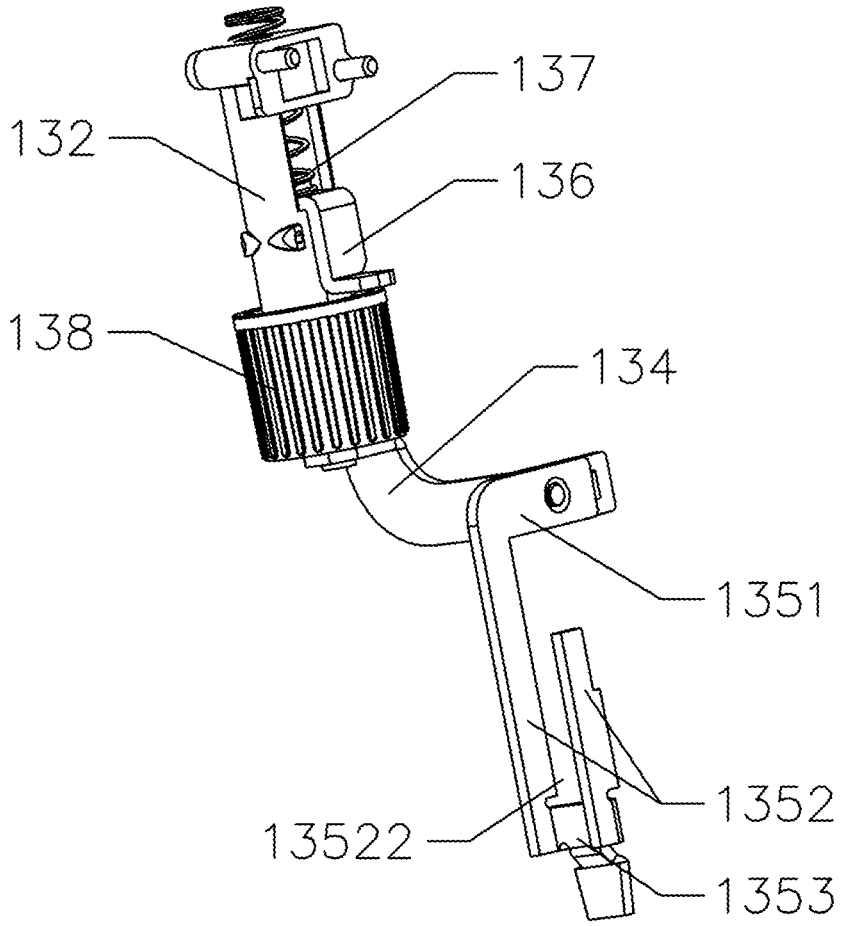
FIG. 18 is a structural schematic diagram of a safety ejector pin assembly in the nail gun according to the present disclosure.
Figure 19:
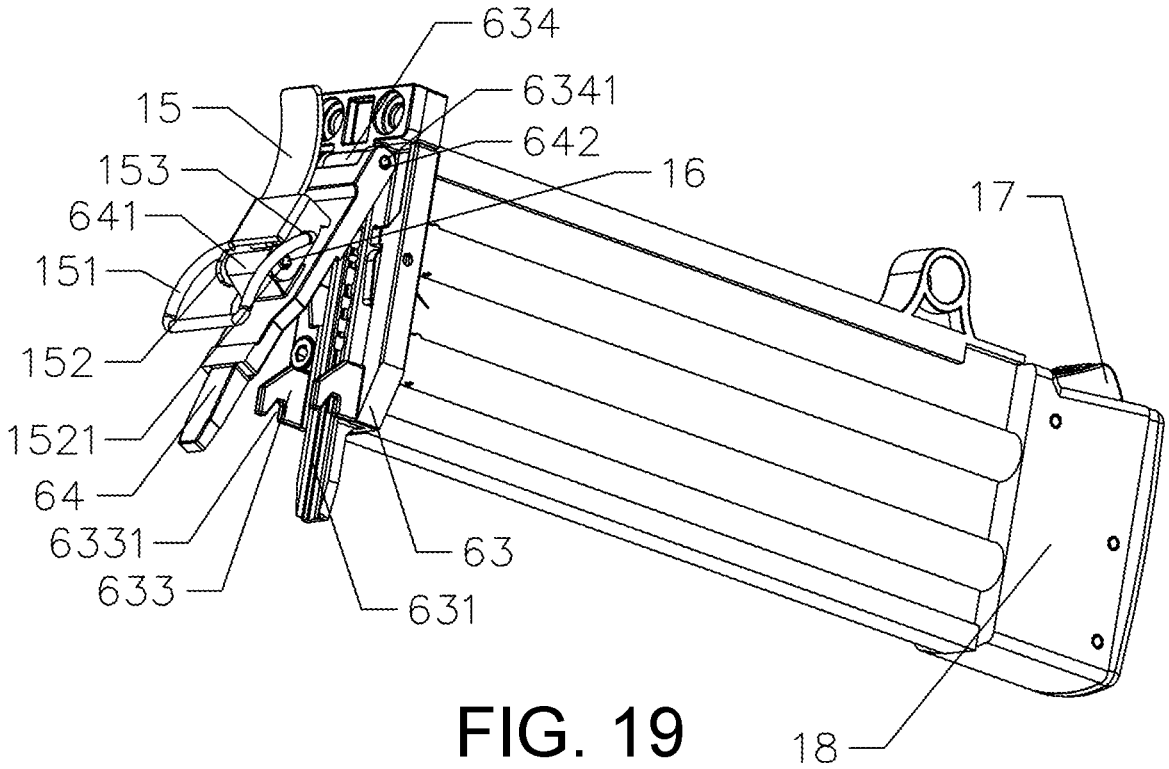
FIG. 19 is a structural schematic diagram after dismantling a nail exit cover plate and a nail exit base plate in the nail gun according to the present disclosure.
Figure 20:
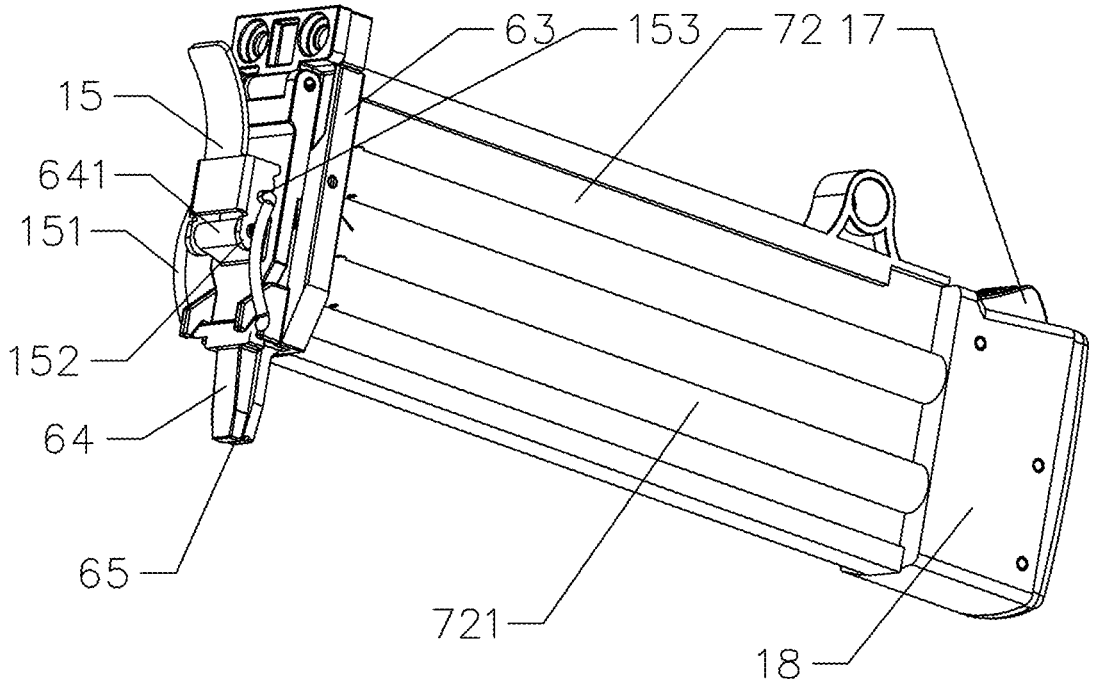
FIG. 20 is a structural schematic diagram after tightly locking the nail exit cover plate and the nail exit base plate in the nail gun according to the present disclosure.
Figure 21:
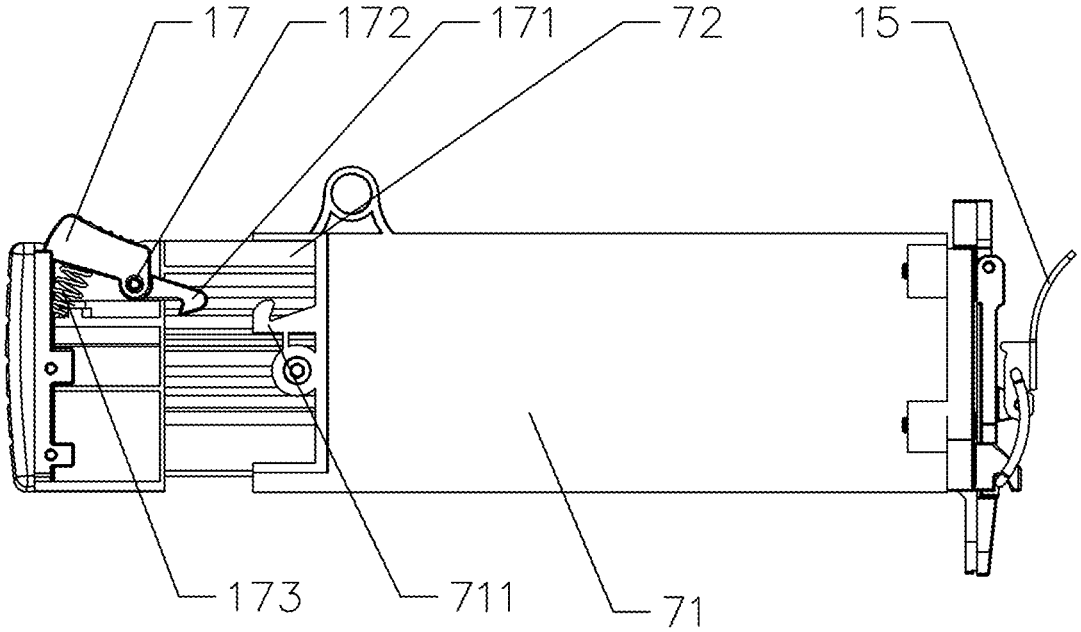
FIG. 21 is a structural schematic diagram after a movable guide rail in the nail gun is pulled out according to the present disclosure.
Figure 22:
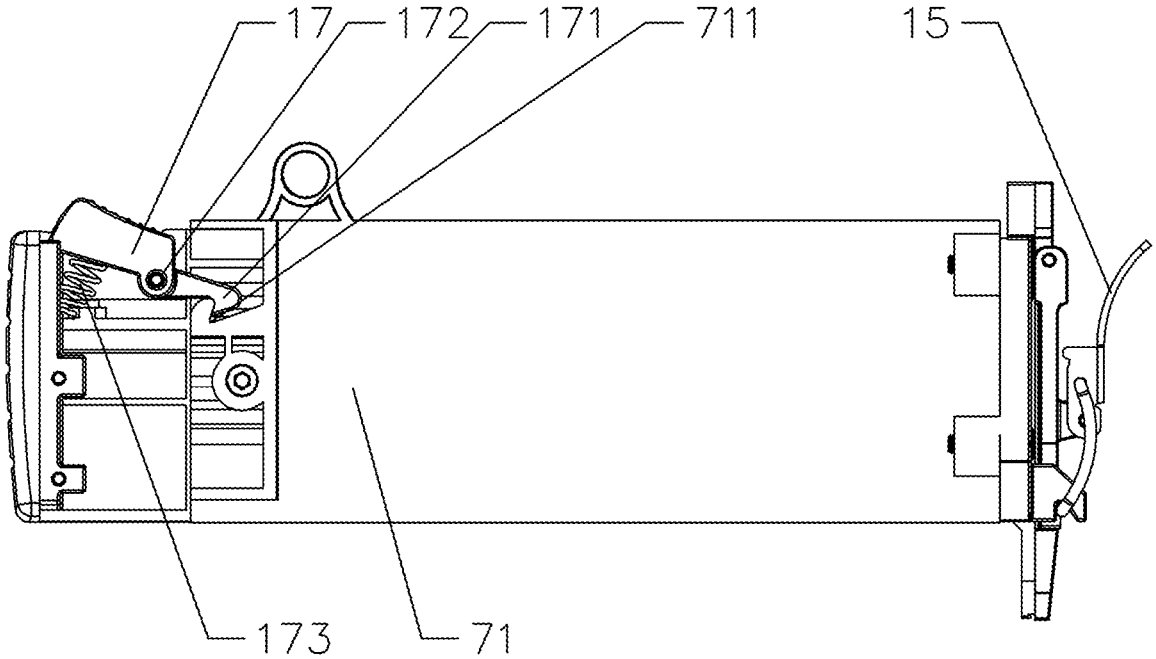
FIG. 22 is a structural schematic diagram after the movable guide rail in the nail gun is pushed in according to the present disclosure.
Figure 23:
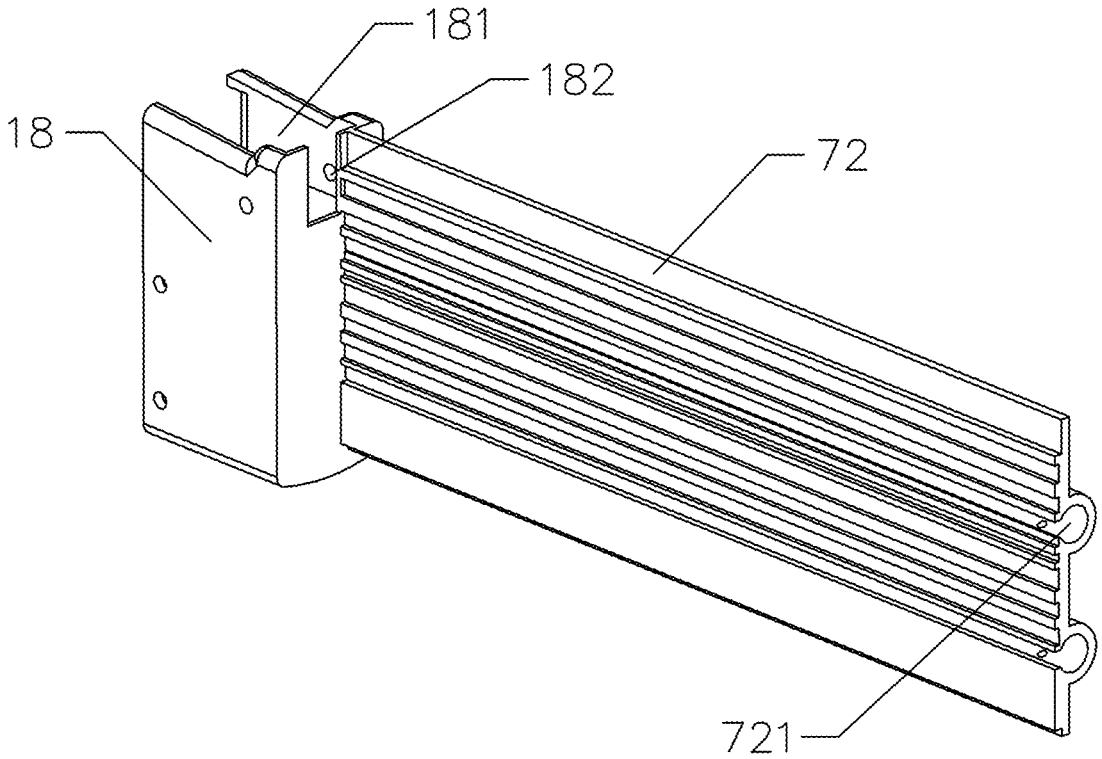
FIG. 23 is a structural schematic diagram of the movable guide rail in the nail gun according to the present disclosure.

As shown in FIGS. 1-23, the present disclosure provides a nail gun which fires nails stably, including: a housing 100, a trigger 21, an electric motor 22, a first cylinder 31, a second cylinder 33, a crank 41, a linkage 42, a nail firing assembly, and a nail supplying assembly. The housing 100 is a plastic housing, which is not only easily formed, but also ensures insularity of the nail gun to ensure use safety. The second cylinder 33 is disposed in the first cylinder 31. Inside the first cylinder 31 is provided a first piston 32, and inside the second cylinder 33 is provided a second piston 34. A linkage 42 is in transmission connection with the first piston 32. The electric motor 22 is in transmission connection with the crank 41 via a transmission mechanism and drives, via the linkage 42, the first piston 32 to make an axial movement within the first cylinder 31. On an off-center side of the first piston 32 is provided a slide hole axially penetrating through the first piston 32, i.e., the slide hole is disposed eccentrically. The first piston 32 is sleeved, via the slide hole, external to the second cylinder 33 and moves along an axial direction of the second cylinder 33. A circulating air channel is provided between the first cylinder 31 and the second cylinder 33. The nail firing assembly includes a fixed seat 61, a striker 62, a nail exit base plate 63, and a nail exit cover plate 64. A lower end of the nail firing assembly is provided with a muzzle 65. The striker 62 is connected with the second piston 34. The first piston 32 motions to compress air in the first cylinder 31. Compressed air is conveyed to the second cylinder 33 via the circulating air channel; the compressed air imposes enough air pressure against the second piston 34, such that the second piston 34 is released and rapidly moves downwardly under the air pressure to drive the striker 62 to strike a nail. The nail supplying assembly includes a guide rail plate 71, a movable guide rail 72 fitted with the guide rail plate 71, and a nail supplying block 73 pushing the nail. A nail supplying elastic element 74 for resetting the nail supplying block 73 is provided between the movable guide rail 72 and the nail supplying block 73. The nail supplying elastic element 74 is specifically a spring, because the spring has a good elasticity, which may guarantee a good pushing force. Besides, the spring is a standard element, which may be directly mounted and used after being purchased and requires no special design. The spring is configured for including a first spring 741 and a second spring 742, wherein the first spring 741 and the second spring 742 are arranged vertically with spacing, which further enhances the pushing force of the nail supplying elastic element so as to guarantee nail supplying effect of the nail supplying block.

In this embodiment, the nail gun includes a trigger switch 23; on the trigger 21 is provided a trigger ejector pin 24 which may trigger the trigger switch 23 after the trigger 21 is pulled. The transmission mechanism includes a decelerator 51, a transmission shaft 52 in transmission connection with the decelerator 51, and a cam 53 sleeved on the transmission shaft 52. A self-lock ejector pin 25 is provided between the cam 53 and the trigger switch 23, such that when the cam 53 moves to a high point, it pushes the self-lock ejector pin 25 to trigger the trigger switch 23 and drives the trigger ejector pin 24 to be detached from the trigger switch 23; and when the cam 53 moves to a low point, the self-lock ejector pin 25 is detached from the trigger switch 23, i.e., the self-lock ejector pin presses against the trigger switch to ensure that the trigger switch is not open, thereby guaranteeing continuous motion of the electric motor and ensuring that the nailing process is not interrupted. The cam continues moving, and when the cam moves to the low point, the self-lock ejector pin is detached from the trigger switch, then the trigger switch is open to interrupt the power supply of the electric motor, and then the electric motor stops working, thereby finishing one action cycle of the nail gun. This manner of controlling the electric motor to finish an action cycle with a mechanical structure is more stable and reliable compared with conventional controlling through detection by a position sensor, thereby ensuring nailing reliability, i.e., guaranteeing working reliability of the nail gun.

To guarantee the reliability of triggering the trigger switch, a rotary shaft 211 may be provided on the trigger 21, a rotary hole 241 is arranged on the trigger ejector pin 24, the trigger ejector pin 24 is sleeved on the rotary shaft 211 via the rotary hole 241 such that the trigger ejector pin 24 may motion with the trigger 21 to trigger the trigger switch 23. This structure is not only simple but also reliable, but also works stably to ensure reliability of triggering the triggering switch, thereby further ensuring operating reliability of the electric motor, i.e., ensuring nailing reliability of the nail gun.

To better ensure working reliability and stability of trigger ejector pin, a torsional spring 26 capable of deflecting the trigger ejector pin 24 may be further sleeved on the rotary shaft 211; a snap groove 242 is provided on the trigger ejector pin 24; one end of the torsional spring 24 is clamped in the snap groove 242 of the trigger ejector pin 24, while the other end thereof abuts against a stop block of the trigger 21. As such, the trigger ejector pin generates a certain torsional force via the torsional spring, which facilitate the trigger ejector pin to maintain a working state, i.e., maintaining a good trigger position state when it is needed to trigger the trigger switch, while maintaining a good detached position state when it is needed to detach from the trigger switch, thereby enhancing working reliability and stability of the trigger ejector pin, such that the trigger ejector pin would not be affected by other external forces.

To ensure the reliability of the cam 53 in contact-actuating the trigger ejector pin, a bump 531 may be provided on the cam 53, such that when the cam moves to the high point, the cam may contact-actuate the lower end of the trigger ejector pin via the bump so as to cause the trigger ejector pin to be deflected and detached from the trigger switch, and further cause the trigger switch to be interrupted, thereby ensuring the reliability of the cam in contact-actuating the trigger ejector pin. Meanwhile, by arranging the bump 531 at one side of the cam 53 proximal to the decelerator 51, it facilitates the bump to avoid the self-lock ejector pin. Namely, when the cam is rotating, the bump does not touch the self-lock ejector pin, which guarantees action reliability of the trigger ejector pin. Besides, arrangement of the bump 531 and the cam 53 into an integral structure, i.e., machining them integrally, facilitates manufacturing and machining of the bump and the cam; besides, an integral structure offers a good strength, durability, and long service life.

To facilitate fitting between the trigger ejector pin and the bump, a guide bevel 243 facilitating the bump 531 to contact-actuate the trigger eject pin is provided at a lower end of the trigger ejector pin 24, which may well guarantee the reliability of the cam in contact-actuating the trigger ejector pin to move, i.e., easily deflecting the trigger ejector pin, so as to facilitate triggering or detaching from the trigger switch.

To facilitate fitting between the self-lock ejector pin and the cam, a lower end of the self-lock ejector pin 25 is provided with a fitting portion 251 fitted with the cam 53, wherein the fitting portion 251 has a big-end-down trapezoidal shape, which enhances a contact area for fitting between the self-lock ejector pin and the cam. As such, reliable fitting between the self-lock ejector pin and the cam is facilitated to guarantee action reliability of the self-lock ejector pin.

To facilitate manufacturing of the nail gun and enhance portability, the housing 100 may be arranged to include a first housing 110 and a second housing 120, wherein a handle position 130 is provided on both of the first housing 110 and the second housing 120; the first housing 110 and the second housing 120 are mutually snap-fitted to form the housing 100; moreover, the two handle positions 130 are snap-fitted to form an integral handle of the nail gun. This not only facilitates structural design and forming of the housing, but also facilitates assembling of elements inside the housing; besides, compact fitting between various elements reduces the overall size of the housing, thereby reducing the oversize of the nail gun and enhancing portability of the nail gun; moreover, when in use, the handle for the user to grasp provides convenience for user manipulation and enhances manipulation efficiency.

To facilitate resetting the pulled trigger for a next pull, a trigger elastic element 212 which automatically resets the trigger 21 may be provided in the housing 100. In this way, the pulled trigger may be automatically reset to prepare for next nailing. The trigger elastic element 212 is specifically set as a spring, because the spring has a good elasticity and may well ensure reset of the trigger; besides, the spring is standard element, which may be directly purchased from the market without a need of special design, thereby reducing the manufacturing cost.

To guarantee a nailing effect of the nail gun, a lock catch assembly which locks the second piston 34 to a high point may be provided at an upper end in the first cylinder 31. An unlocking ejector pin 9 is provided on the first piston 32, wherein the unlocking ejector pin 9 is fixed with the first piston 32 via a latch. The first piston 32 moves upwards to drive the unlocking ejector pin 9 to move upwardly; the unlocking ejector pin 9 pushes the lock catch assembly to be detached from the second piston 34 so as to release the second piston 34. Moreover, under air pressure, the second piston 34 moves downwardly to cause the striker 62 to strike the nail. With the mechanical lock catch structure, pressure is maintained against locking of the second piston, which is more reliable and stable compared with a conventional magnetic locking manner with magnetic elements, such that individual discrepancies among magnetic elements would not cause instability or nonuniform of magnetic forces; the unstable or nonuniform magnetic forces would further cause nail firing under insufficient pressure against the second piston, which would affect the final nailing effect. In other words, the manner of locking and pressurizing the second piston by the lock catch assembly may well guarantee a nailing effect; the unstable factors inherent in the parts would not affect the nailing effect, such that nailing stability and nailing effect of the nail gun are guaranteed. Meanwhile, the lock catch assembly offers a reliable locking and an ease of detaching from the second piston. Further, the lock catch assembly has a simple structure such that it is easily manufactured.

To guarantee the nailing effect and nailing stability, the second piston 34 may be configured to include a piston core 341 and a piston bush 342 sleeved on the piston core 341. An upper end of the piston core 341 is provided with a bayonet 3411 fitted with the lock catch assembly; the bayonet on the piston core is fitted with the lock catch assembly to maintain pressure against locking of the second piston, which not only facilitates the lock catch assembly to lock the second piston, but also facilitates detaching the released second piston from the lock catch assembly, thereby guaranteeing the nailing effect and nailing stability. Meanwhile, to facilitate connection between the striker and the second piston, the nail gun is further provided with a connecting sleeve 343 in connection with the piston core 341; the connecting sleeve 343 is inserted into an inner hole at the lower end of the piston 341 and is fixedly connected therewith via a screw. The striker 62 and the connecting sleeve 343 are fixedly connected via a latch to thereby co-move with the second piston 34, which not only facilitates connection between the striker and the second piston, but also offers a secure and reliable connection to make them hard to be disconnected.

To facilitate mounting of the lock catch assembly and ensure the nailing effect, a mounting seat 10 may be provided at the upper end inside the first cylinder. The mounting seat 10 has a round disc shape and is configured to match the profile of the first piston 32; inside the mounting seat 10 is provided a mounting slot 101, wherein the lock catch assembly is installed in the mounting slot 101; a notch 102 for the unlocking ejector pin 9 to extend into is provided at a bottom portion of the mounting seat 10, and the unlocking ejector pin 9 penetrates through the notch 102 to act in cooperation with the lock catch assembly. Arrangement of the mounting seat and the mounting slot not only facilitates mounting and fixing the lock catch assembly, but also facilitate the unlocking ejector pin to contact-actuate the lock catch assembly when the first piston moves to the high point, thereby guaranteeing that the second piston may be well released and further guaranteeing a no-delay, accurate, and efficient nailing.

Further, the lock catch assembly includes a lock catch 81 and a lock catch elastic element 82 configured for pushing the lock catch 81 to reset. On the lock catch 81 are provided a limiting step 811 fitted with the bayonet 3411 and an open slot 812 in communication with the notch 102. A pushing bevel 813 fitted with the unlocking ejector pin 9 is provided at an inner sidewall of the lower end of the open slot 812. The lock catch elastic element enables the lock catch, after being detached from the second piston, to be reset to the initial position; after the second piston is reset, it is locked by the lock catch again, ready for a next nailing action. In this way, working continuity of the nail gun is guaranteed, and working efficiency of the nail gun is enhanced. Meanwhile, when the second piston is locked by the lock catch, the elastic force of the lock catch elastic element may well guarantee the locking force with respect to the second piston, i.e., guaranteeing that the second piston is not easily detached, wherein only under enough pressure force and under contact actuation from the unlocking ejector pin, can the second piston be detached. Moreover, arrangement of the open slot and the pushing bevel facilitates the unlocking ejector pin to contact-actuate the lock catch so as to guarantee that the lock catch can be accurately detached from the second piston to thereby release the second piston to perform nail shooting. Further, a mounting hole 814 is provided inside the rear end of the lock catch 81. One end of the lock catch elastic element 82 is mounted inside the mounting hole 814, while the other end thereof abuts against the inner wall of the mounting seat 10. Arrangement of the mounting hole facilitates limiting the lock catch elastic element to prevent deflection of the lock catch elastic element from the radial direction, which guarantees working reliability of the lock catch elastic element, i.e., causing the lock catch elastic element to push the lock catch stably and reliably.

To facilitate axial motion of the lock catch assembly, a guide rail 11 may be provided in the mounting slot 101, wherein a profile of the guide rail 11 is arranged to match that of the mounting slot 101. The guide rail 11 is provided with a slideway 111, wherein the lock catch assembly is disposed in the slideway 111. A through port 112 in communication with the notch 102 is provided at a bottom wall of the guide rail 11, which may reduce the friction between the lock catch and the mounting slot and the friction between the lock catch elastic element and the mounting slot, while facilitating guiding the motion of the lock catch and the lock catch elastic element so as to guarantee the overall working reliability and stability of the lock catch assembly.

To guarantee nailing stability and nailing effect, an upper end of the piston core 341 may project out of a top wall of the second cylinder 33; a guide bush 12 is provided between the upper end of the piston core 341 and the top wall of the second cylinder 33. The guide bush 12 has a hollow cavity that is in communication with an inner cavity of the second cylinder 33. An air flow hole 104 in communication with the inner cavity of the first cylinder 31 is provided on the mounting seat 10; on the mounting seat 10 is provided a penetrated hole 103 for the guide bush 12 to penetrate through; an air guide hole 121 in communication with the air flow hole 104 is provided on the guide bush 12, the air guide hole 121 being further in communication with the hollow cavity of the guide bush 12; and the air flow hole 104, the air guide hole 121, and the hollow cavity of the guide bush jointly form the air flow channel so as to communicate the first cylinder 31 with the second cylinder 32. An upper end of the piston core 341 is movably, along with motion of the second piston, inserted into the hollow cavity of the guide bush 12. Namely, when the second piston 34 is at the high point, the piston core 341 is inserted, along with motion of the second piston, into the hollow cavity of the guide bush 12 and abuts, via the piston sleeve 342, against the inner surface of the top wall of the second cylinder 31 so as to enclose the lower end of the hollow cavity, thereby disconnecting between the first cylinder 31 and the second cylinder 33. When the second piston 34 is at the low point, the piston core 341, along with motion of the second piston, is detached from the hollow cavity of the guide bush 12, and the piston sleeve 342 does not abut against the inner surface of the top wall of the second cylinder 31 either, which causes the second cylinder 33 to communicate with the first cylinder 31. The upper end of the guide bush 12 penetrates through the mounting seat 10 and the top wall of the first cylinder 31; an upper end periphery of the guide bush 12 is provided with an external thread and is fixed, via a nut, to the top wall of the first cylinder 31. Arrangement of the guide bush may not only facilitate fixing the second cylinder and the mounting seat, but also may communicate the second cylinder with the first cylinder, to ensure enough pressure against the second piston, thereby ensuring nailing stability and nailing effect.

To facilitate locking or detachment between the lock catch assembly and the bayonet on the piston core, an upper end side wall of the guide bush 12 is provided with a side opening 122 for the lock catch assembly to penetrate through so as to act in cooperation with the bayonet 3411. This arrangement facilitates locking or detachment between the lock catch assembly and the bayonet on the piston core; moreover, the connection is reliable and stable; further, structural design becomes easier.

To guarantee enough striking force of the striker, a lower end of the guide bush 12 may be provided with an annular step 123 fitted with a top wall inner surface of the second cylinder 33, wherein a first sealing ring 124 is provided between the annular step 123 and the top wall inner surface of the second cylinder 33, which enhances sealing at the joint between the guide bush and the second cylinder and guarantees no air leakage, thereby guaranteeing enough pressure against the second piston, guaranteeing enough striking force of the striker, and further guaranteeing the nailing effect.

To enhance use safety of the nail gun, the nail gun may further include a safety ejector pin assembly at one side of the fixed seat 61, wherein the safety ejector pin assembly includes a safety switch 131, a bushing support 132 fixed on the fixed seat 61, a movable inner tube 133 movably disposed in the bushing support 132, a connecting rod 134 in connection with the movable inner tube 133, and a safety ejector pin 135 in connection with the connecting rod 134. A trigger safety switch 131 and a contact-actuating frame 136 which is movable along with the movable inner tube 133 are provided at an upper end of the movable inner tube 133, such that when the nail gun performs nailing, the trigger can only be pulled when the safety ejector pin is pressed to energize the safety switch, and then the electric motor rotates to start nailing. In other words, without pressing against the safety ejector pin, the trigger cannot be pulled to drive the electric motor to rotate, i.e., the nail gun cannot be energized to work, which enhances use safety of the nail gun. Meanwhile, a nailing depth is affected by the distance between the muzzle and a wood board. Specifically, the closer the distance from the muzzle is, the deeper the nail is driven into the wood board; the farther the distance between the muzzle and the wood board is, the shallower the nail is driven into the wood board. By configuring the safety ejector pin 135 to be continuously movable along the axial direction of the movable inner tube 133 so as to adjust the axial distance between the bottom end of the safety ejector pin 135 and the muzzle 65 (wherein change of the axial distance refers to change of the distance between the muzzle and the wood board, and adjusting the movable inner tube to adjust the axial distance between the bottom end of the safety ejector pin and the muzzle refers to adjusting the distance between the muzzle and the wood board), nailing depth becomes adjustable to ensure the nailing effect. That is, the axial distance between the bottom end of the safety ejector pin and the muzzle may be adjusted based on depths of different wood boards, thereby guaranteeing a good nailing effect and further enhancing the adaptability of the nail gun, i.e., enabling the nail gun to nail wood boards of different depths.

To guarantee reliability and stability of the nailing depth, the connecting rod 134 may be thread connected with the movable inner tube 133 such that the connecting rod 134 may move along an axial direction of the movable inner tube 133. By implementing axial movement in a threaded fashion, the nailing depth becomes adjustable. Besides facilitating depth adjustment, because the thread has good self-locking property, the adjusted nailing depth does not easily change, thereby guaranteeing the reliability and stability of the nailing depth.

To facilitate adjusting the nailing depth, the safety ejector pin assembly further includes an adjusting nut 138, the adjusting nut 138 being sleeved at an outer periphery of the movable inner tube 133; rotation of the adjusting nut 138 enables an axial motion between the movable inner tube 133 and the connecting rod 134, thereby adjusting the axial distance between the bottom end of the safety ejector pin 135 and the muzzle 65 so as to further adjust the distance between the muzzle and the wood board and finally realize adjustability of nailing depth; moreover, this manner of adjusting the nut through rotation greatly facilitates user operation, enhances operation convenience of the nail gun, and improves user experience and satisfaction in using the nail gun.

To ensure reliability of the safety ejector pin assembly in contact-actuating the safety switch, the safety switch 131 may be disposed at one side of the bushing support 132; the side wall of the bushing support 132 is provided with an opening 1321 for a contact-actuation frame 136 to project out. The contact-actuating frame 136 includes a movable portion 1361 and a contact-actuating portion 1362, wherein the movable portion 1361 is connected to an upper end of the movable inner tube 133, the contact-actuating portion 1362 projects out of the opening 1321 to be fitted with the safety switch 131, and the contact-actuating frame 136 moves axially inside the bushing support 132 along with the movable inner tube 133 to realize closing or opening of the safety switch. This manner of contact-actuating the safety switch not only enables a stable and reliable contact-actuation, but also offers a simple structure and an ease of manufacturing and assembling.

To facilitate resetting of the contact-actuating frame, a contact-actuation elastic element 137 for resetting the contact-actuating frame 136 is provided between the upper end of the movable portion 1361 and the top end of the bushing support 132, which facilitates resetting the contact-actuating frame to prepare for next nailing, thereby guaranteeing working continuity of the nail gun, and further enhancing working efficiency of the nail gun.

The structural design requirement of the nail gun easily limits, to a certain extent, the structure of some parts of the nail gun and arrangement of their positions; by designing the longitudinal cross section of the connecting rod 134 to an "L" shape, the connection distance between the connecting rod and the safety ejector pin is prolonged, which enables the designed position of the safety ejector pin to be immune from influences from other parts and ensures, in priority, that the safety ejector pin can only co-movably trigger the safety switch during normal use of the nail gun, while a general misoperation cannot cause the nail gun to fire, thereby further enhancing use safety of the nail gun and meanwhile avoids motion interference between respective parts, which guarantees working stability of the nail gun.

To facilitate connection between the connecting rod and the safety ejector pin, the connecting rod 134 may be configured to include a connection portion 1341 fitted with the movable inner tube 133 and a fixed portion 1342 connected with the safety ejector pin 135; besides, the connection portion 1341 is arranged in a bar shape, which facilitates fitting between the connection portion and the movable inner tube; particularly, a threaded structure is adopted to cause axial movement between the connecting rod and the movable inner tube; while the fixed portion 1342 is arranged in a plate shape, which facilitates connection with the safety ejector pin and reduces machining difficulty, where the fixed portion may be formed by a simple stamping process.

To simplify the structure of the safety ejector pin and guarantee working reliability of the nail gun, the safety ejector pin 135 may be configured to include a bent portion 1351, a vertical portion 1352, and a support portion 1353, which are connected to the connecting rod 134, wherein the vertical portion 1352 includes two symmetrically arranged parallel side plates 13521; one parallel side plate 13521 thereof is connected to the bent portion 1351; the support portion 1353 is disposed at lower ends of the two parallel side plates 13521 to integrally connect the two parallel side plates 13521. This kind of safety ejector pin not only has a simple structure which is easily formed, but also works reliability to guarantee working reliability of the nail gun; meanwhile, the safety ejector pin 135 is provided into an overall plate shape, which facilitates forming of the safety ejector pin, enhances machining efficiency, and further improves overall machining efficiency of the nail gun. Specifically, the safety ejector pin 135 is a metal safety ejector pin, which guarantees enough strength of the safety ejector pin, and further ensures durability and improves service life.

To guarantee that the safety ejector pin, when being abutted against, does not deflect, a guide groove 13522 may be formed between two parallel side plates 13521; the two parallel side plates 13521 are disposed at two sides of a projecting portion 621 of the nail exit base plate 631; as such, when abutting against the safety ejector pin, the safety ejector pin may be guaranteed not to be deflected, thereby guaranteeing that co-movement of the safety ejector pin to stably trigger the safety switch and guaranteeing working stability of the nail gun.

To guarantee use safety of the nail gun without nails, a dry fire proof ejector pin 141 may be provided on the nail exit base plate 63; a pin shaft 142 penetrating through the dry fire proof ejector pin 141 is further provided on the nail exit base plate 63; an ejector block 143 is provided between the dry fire proof ejector pin 141 and the nail supplying elastic element 74; as such, when there exist no nails in the nail supplying assembly, the nail supplying elastic element 74 may push against the ejector block 143, and the ejector block 143 further pushes against the dry fire proof ejector pin 141 to axially limit the safety ejector pin 135, thereby preventing the safety ejector pin 135 from contact-actuating the safety switch 131, namely the nail gun cannot perform a nailing work, which guarantees use safety when the nail gun has no nails.

To guarantee working reliability and stability of the dry fire proof ejector pin, a dry fire proof torsional spring 145 which causes the dry fire proof ejector pin 141 to maintain an acting position may be provided on the pin shaft 142; as such, after the dry fire proof ejector pin acts, a post-action state may be well maintained by the dry fire proof torsional spring, which prevents the dry fire proof ejector pin from resetting to a pre-action state, thereby guaranteeing the working reliability and stability of the dry fire proof ejector pin.

To guarantee nail supplying stability, an accommodation groove 721 for mounting the nail supplying elastic element 74 may be provided on the movable guide rail 72. The nail supplying elastic element 74 specifically includes a first spring 741 and a second spring 742; correspondingly, the accommodation groove 721 is also provided with two springs corresponding to the first spring 741 and the second spring 742. A front end of the nail supplying elastic element 74 is provided with an elastic element ejector block 75, wherein the elastic element ejector block 75 is disposed in the accommodation groove 721. The nail supplying elastic element is installed inside the accommodation groove and the elastic element ejector block presses the nail supplying elastic element tightly into the accommodation cavity, the nail supplying elastic element constantly maintain a compressed elastic force, such that the nail supplying elastic element may constantly press against the nail supplying block, and the nail supplying block presses against a nail to deliver it. As such, it may be well guaranteed that the direction of pushing the nail supplying elastic element is not deflected, thereby guaranteeing stability of nail supplying. Meanwhile, when there exist no nails, the nail supplying elastic element 74 pushes against the ejector block 143 via the elastic element ejector block 75, causing the dry fire proof ejector pin 141 to axially limit the safety ejector pin 135, thereby preventing telescoping of the safety ejector pin 135 from contact-actuating the safety switch 131. Besides, the elastic element ejector block 75 is in fit contact with the ejector block 143; the large fit contact area facilitates pushing against the ejector pin in a better way, which guarantees that the ejector pin imposes an enough pushing force against the dry fire proof ejector pin and further guarantees that the dry fire proof ejector pin reliably limits the safety ejector pin axially.

To ensure the reliability and stability of the ejector block to push the dry fire proof ejector pin, the ejector block 143 may be movably provided in the accommodation groove 721 and disposed at the front end of the elastic element ejector block 75; besides, a limiting pin 144 that limits the ejector block 143 is disposed at the front end of the accommodation groove 721; this may well limit the ejector block to prevent escaping of the ejector block, thereby guaranteeing the reliability and stability of the ejector block in pushing the dry fire proof ejector block.

To guarantee the working effect of the ejector block, the ejector block 143 may be configured to include a body 1431 and a first pushing portion 1432 and a second pushing portion 1433 which are disposed at two ends of the body 1431 in stagger, wherein the first pushing portion 1432 acts in cooperation with the dry fire proof ejector pin 141, and the second pushing portion 1433 acts in cooperation with the elastic element ejector block 75, causing that the cross section of the ejector block 143 to have a stepped shape; as such, the first pushing portion and the second pushing portion may not only work independently without mutual interference, but also may well form a limiting fixation to the ejector block.

To facilitate arranging the structures and positions of the safety ejector pin and the safety switch, a trigger assembly may be provided between the safety ejector pin 135 and the safety switch 131, the safety ejector pin 135 contact-actuates the safety switch 131 via a trigger assembly. The trigger assembly includes a bushing support 132 fixed on the fixed seat 61, a movable inner tube 133 movably disposed in the bushing support 132, and a connecting rod 134 in connection with the movable inner tube 133, wherein the safety ejector pin 135 is connected to the connecting rod 134. Arrangement of the trigger assembly extends the trigger distance between the safety ejector pin and the safety switch, which facilitates arrangement of the structures and positions of the safety ejector pin and the safety switch while reduces limitations to the design thereof.

To facilitate dismounting the nail exit base plate and the nail exit cover plate in the case of nail jam, the nail exit cover plate 64 may be hinged with the nail exit base plate 63, and a locking pressing handle 15 is hinged on the nail exit cover plate 64; a locking spring fastener 151 is provided on the locking pressing handle 15; a locking snap groove 632 fitted with the locking spring fastener 151 is provided on the nail exit base plate 63. As such, when the locking pressing handle is closed, the locking spring fastener may be tightly clamped in the locking snap groove; meanwhile, after opening the locking pressing handle, the locking spring fastener may be detached from the locking snap groove. That is, in the case of nail jam, the nail exit cover plate and the nail exit base plate may be rapidly dismantled by opening the locking pressing handle to thereby remove the stuck nail, which greatly improves the operation convenience of dismounting the nail firing assembly and meanwhile reduces the dismantling time for the user; further, the use efficiency of the nail gun is improved, and the user working efficiency is enhanced.

To facilitate the hinging arrangement between the locking pressing handle and the nail exit cover plate, a cover plate hinge boss 641 is provided on the nail exit cover plate 64; a cover plate hinge boss hole is provided on the cover plate hinge boss 641; hinge lugs 152 at two sides of the cover plate hinge boss 641 are provided on the locking pressing handle 15; a hinge lug hole 1521 is provided on the hinge lug 12; the nail gun further includes a pin shaft 16; as such, the pin shaft penetrates through the hinge lug hole and the cover plate hinge boss hole to hinge the locking pressing handle and the nail exit cover plate together to thereby implement hinging between the locking pressing handle and the nail exit cover plate, which causes the locking pressing handle to rotate about the nail exit cover plate to form tight locking between the locking spring fastener and the locking snap groove. Meanwhile, the cover plate hinge boss 641 and the nail exit cover plate 64 are integrally formed, which facilitates forming thereof; besides, the integral structure offers a good strength, durability, and long service life.

Moreover, two sides of the locking pressing handle 15 are each provided with a rotary hole 153; two ends of the locking spring fastener 151 are inserted into the rotary holes 153 to cause the locking spring fastener 151 to rotate about the locking pressing handle 15, which facilitates fitting between the locking spring fastener and the locking snap groove, so as to securely fix the nail exit cover plate with the nail exit base plate; the fixation is reliable and hardly loosened, thereby guaranteeing working reliability of the nail gun.

To facilitate forming of the locking snap groove, two bosses 633 are provided on the nail exit base plate 63; the two bosses 633 are arranged with an internal to form an interval groove avoiding the nail exit cover plate 64; the two bosses 633 are each provided with a notch 6331; the notches 6331 form the locking snap groove 632, which may limit the nail exit cover plate without a need of separately providing a locking snap groove. By forming the snap grooves with the notches, it not only simplifies the machining process, but also may guarantee the strength of the locking snap groove, thereby guaranteeing the reliability of locking the nail exit cover plate and making it hardly loosened; meanwhile, the two bosses 633 and the nail exit base plate 63 are integrally formed, which facilitates forming of the two; besides, the integral structure of the two offers a good strength, durability, and service life.

To facilitate the hinging arrangement between the nail exit base plate and the nail exit cover plate, a base plate hinge boss 634 is provided on one end of the nail exit base plate 63 distant from the muzzle 65; a hinge column 6341 is arranged at each of two sides of the base plate hinge boss 634; one end of the nail exit cover plate 64 distant from the muzzle is provided with a cover plate hinge hole 642. The cover plate hinge hole 642 and the hinge column 6341 are fitted to hinge the nail exit cover plate 64 and the nail exit base plate 63 together. As such, when the nail exit cover plate is removed, the nail exit cover plate is still connected with the nail exit base plate, rather than being completely detached therefrom; this may prevent loss of the nail exit cover plate. Further, after the stuck nail is removed, the nail exit cover plate may be directly locked tightly to resume normal nailing work, which not only facilitates operating on the nail gun, but also improves use efficiency of the nail gun, and further improves working efficiency of the user. Meanwhile, the hinge column 6341 is integrally formed with the base plate hinge boss 634, and the base plate hinge boss 634 is integrally formed with the nail exit base plate 63, which facilitates forming of the three; besides, the integral structure of the three offers a good strength, durability, and long service life.

To facilitate forming of the locking spring fastener, the locking spring fastener 151 may be formed by integrally bending a metal strip, which facilitates forming of the locking spring fastener; besides, the locking spring fastener may offer a good strength, durability, and long service life.

To enhance durability of the nail exit base plate and the nail exit cover plate, the nail exit base plate 63 may be configured as a metal nail exit base plate; besides, the nail exit cover plate 64 is configured as a metal nail exit cover plate, which may well enhance the strength of the nail exit base plate and the nail exit cover plate, while further improving the durability and service life of the nail exit base plate and the nail exit cover plate.

To guarantee stability and reliability of nail supplying, a movable button 17 may be provided on the movable guide rail 72; a locking hook 171 is provided on the movable button 17; a snap hook 711 fitted with the locking hook 171 is provided on the guide rail plate 71; by depressing the movable button 17, the locking hook 171 may be detached from the snap hook 711; after the nail gun is mounted on the guide rail plate, the movable guide rail is snap-fitted; by fitting between the locking hook and the snap hook, the movable guide rail and the guide rail plate may be locked together to thereby ensure stability and reliability of nail supplying.

To facilitate a depressing operation on the movable button, a rear seat 18 may be provided at a rear end of the movable guide rail 72; a mounting cavity 181 is provided on the rear seat 18; the movable button 17 is hinged in the mounting cavity 181; as such the movable button may be partially or completely concealed in the mounting cavity of the rear seat, which improves overall appearance of the nail gun and meanwhile facilitates the depressing operation on the movable button.

To facilitate a hinging arrangement between the movable button and the rear seat, a button hinge hole 172 may be arranged at a joint between the movable button 17 and the locking hook 171; a side wall of the mounting cavity 181 is provided with a rear seat hinge hole 182 and further a hinge shaft 19; as such, the hinge shaft penetrates through the rear seat hinge hole and the button hinge hole to connect the movable button and the rear seat together, causing the movable button to be rotatable about the hinge shaft, thereby implementing locking or detaching between the locking hook and the snap hook, which facilitates user operation and improves use convenience.

To make it easier to depress the movable button and make the locking more reliable, a button elastic element 173 for resetting the movable button 17 may be further provided at the rear end of the movable button 17. Arrangement of the button elastic element not only facilitates depression when the locking hook is detached from the snap hook, which means making the depression easy and convenient, but also guarantees locking reliability between the locking hook and the snap hook such that the locking would not be easily loosened. Besides, the locking hook 171 and the movable button 17 are integrally formed; and the snap hook 711 and the guide rail 71 are integrally formed. As such, the strength of the locking hook and the snap hook are enhanced, and the durability of the locking hook and the snap hook are improved.

To better enhance operation convenience of the nail gun, a battery pack 200 may be disposed at the rear end of the housing 100 proximal to the handle position 130. The battery pack 200 is a lithium battery pack, which powers the whole nail gun to facilitate the nail gun to finish the nailing work. As such, the nail gun will be free from power lines when in use. Therefore, the nail gun may be used more conveniently, even available for outdoor work, which greatly improves use convenience of the nail gun.

To further improve use safety of the nail gun, a power switch 27 may be further provided. Besides, the power switch 27 is a main circuit switch disposed above the trigger 21. After the trigger 21 is pulled, the power switch 27 is switched on, which conducts the entire circuit of the nail gun. As such, the nail gun can only work normally after the power switch 27 is closed, further ensuring use safety of the nail gun.

To further enhance use convenience of the nail gun, the nail gun may be further provided with an MCU (Microcontroller Unit) and a selector switch 28 which enables the nail gun to switch freely between a single nail mode and a continuous nail mode. The selector switch 28 is electrically connected with the MCU, which enables the nail gun to switch between the single nail mode and the continuous nail mode so as to meet different work requirements, thereby enhancing working efficiency of the nail gun. Specifically, when the selector switch 28 switches to the continuous nail mode, the trigger 21 is held to be pulled to continuously press against the safety ejector pin 135 to trigger the safety switch 131, thereby implementing continuous nailing of the nail gun; when the selector switch 28 switches to the single nail mode, the trigger 21 is pulled to press against the safety ejector pin 135 to trigger the safety switch 131 so as to make one nailing. Under the single nail mode, even the trigger is held to pulled again to press against the safety ejector pin 135, the nail gun still only performs nailing once. In the case of requiring nailing again, the trigger 21 has to be pulled again to implement another nailing.

To ensure trigger reliability of respective switches, the trigger switch 23, the power switch 27, the selector switch 28, and the safety switch 131 are all arranged as micro snap-action switches so as to facilitate fitting with mechanical structures and facilitate structural design. Besides, the micro snap-action switches have a high reliability in triggering the mechanical structures, thereby guaranteeing reliability and stability of respective actions.

Meanwhile, the micro snap-action switches are common electronic elements without a need of special designs, which may be directly purchased and applied, thereby reducing manufacturing costs of respective switches.

It may be understood that the unlocking ejector pin may also be fixed on the first pistol by screws, interference-fit, snapping, riveting, adhering, inject molding, or welding.

It may be understood that the trigger elastic element may also be an elastic sheet or elastic block, which can also implement resetting of the trigger.

It may be understood that a hinge plate may be alternatively fixed to the upper end of the nail exit base plate, wherein the nail exit cover plate is hinged to the hinge plate. In other words, the nail exit base plate includes a detachable hinge plate.

It may be understood that alternatively, only the nail exit base plate is metal, or only the nail exit cover plate is metal.

It may be understood that alternatively, only the locking hook is integrally formed with the movable button; or alternatively, only the snap hook is integrally formed with the guide rail plate.

It may be understood that the nail gun may also be powered by a power cable.

Besides the preferred embodiments above, the present disclosure further has other embodiments. Those skilled in the art may make various alterations and transformations based on the present disclosure, which should all fall into the scope defined by the appended claims of the present disclosure without departing from the spirit of the present disclosure.

We claim:

1. A nail gun which fires nails stably, comprising: a housing, a trigger, an electric motor, a first cylinder, a second cylinder, a crank, a linkage, a nail tiring assembly, and a nail supplying assembly, the second cylinder being disposed in the first cylinder, inside the first cylinder being provided a first piston, inside the second cylinder being provided a second piston, the linkage being in transmission connection with the first piston, the electric motor being in transmission connection with the crank via a transmission mechanism, and the electric motor driving the first piston via the linkage to make an axial motion in the first cylinder, the nail firing assembly comprising a striker which is connected with the second piston, wherein an upper end inside the first cylinder is provided with a lock catch assembly locking the second piston to a high point, an unlocking ejector pin is provided on the first piston, the first piston moves upwards to drive the unlocking ejector pin to move upwardly, such that the unlocking ejector pin pushes the lock catch assembly to be detached from the second piston, and then the second piston moves downwardly under an air pressure to cause the striker to strike the nail, wherein the second piston comprises a piston core and a piston bush sleeved on the piston core, an upper end of the piston core is provided with a bayonet fitted with the lock catch assembly, the upper end inside the first cylinder is provided with a mounting seat, and inside the mounting seat is provided a mounting slot, wherein the lock catch assembly is installed in the mounting slot;

a notch for the unlocking ejector pin to extend into is provided at a bottom portion of the mounting seat, and the unlocking ejector pin penetrates through the notch to act in cooperation with the lock catch assembly, the lock catch assembly comprises a lock catch and a lock catch elastic element which pushes the lock catch to reset, a limiting step fitted with the bayonet and an open slot in communication with the notch are provided on the lock catch, and a push bevel fitted with the unlocking ejector pin is provided at an inner side wall of a lower end of the open slot.

2. The nail gun according to claim 1, wherein a mounting hole is provided inside a rear end of the lock catch, wherein one end of the lock catch elastic element is mounted in the mounting hole, and the other end thereof abuts against an inner wall of the mounting seat.

3. The nail gun according to claim 1, wherein a guide rail is provided in the mounting slot, wherein a profile of the guide rail is arranged to match that of the mounting slot;

the guide rail is provided with a slideway, wherein the lock catch assembly is disposed in the slideway; and a bottom wall of the guide rail is provided with a through port in communication with the notch.

4. The nail gun according to claim 1, wherein the upper end of the piston core projects out of a top wall of the second cylinder;

a guide bush is provided between the upper end of the piston core and the top wall of the second cylinder;

an upper end of the guide bush penetrates through the mounting seat and a top wall of the first cylinder; and an upper end periphery of the guide bush is provided with an external thread and is fixed, via a nut, onto a top wall of the first cylinder.

5. The nail gun according to claim 4, wherein an upper end side wall of the guide bush is provided with a side opening for the lock catch assembly to penetrate through so as to act in cooperation with the bayonet.

6. The nail gun according to claim 4, wherein a lower end of the guide bush is provided with an annular step fitted with a top wall inner surface of the second cylinder, wherein a first sealing ring is provided between the annular step and the top wall inner surface of the second cylinder.

7. The nail gun according to claim 1, wherein the nail gun comprises a trigger switch;

a trigger ejector pin which can trigger the trigger switch upon trigger-pulling is provided on the trigger;

the transmission mechanism comprises a decelerator, a transmission shaft in transmission connection with the decelerator, and a cam sleeved on the transmission shaft; and a self-lock ejector pin is provided between the cam and the trigger switch, such that when the cam moves to the high point, it pushes the self-lock ejector pin to trigger the trigger switch and detach the trigger ejector pin from the trigger switch;

while when the cam moves to a low point, the self-lock ejector pin is detached from the trigger switch.

8. The nail gun according to claim 7, wherein the trigger is provided with a rotary shaft, and the trigger ejector pin is provided with a rotary hole, such that the trigger ejector pin is sleeved, via the rotary hole, on the rotary shaft so as to cause the trigger ejector pin to motion with the trigger to trigger the trigger switch.

9. The nail gun according to claim 8, wherein a torsional spring causing the trigger ejector pin to deflect is further sleeved on the rotary shaft; a snap groove is provided on the trigger ejector pin; one end of the torsional spring is clamped in the snap groove of the trigger ejector pin, and the other end thereof abuts against a stop of the trigger.

10. The nail gun according to claim 9, wherein a bump is provided on the earn, such that when the cam moves to the high point, the bump contact-actuates a lower end of the trigger ejector pin to cause the trigger ejector pin to be deflected and detached from the trigger switch.

11. The nail gun according to claim 10, wherein the lower end of the trigger ejector pin is provided with a guide bevel which facilitates the bump to contact-actuate the trigger ejector pin.

12. The nail gun according to claim 10, wherein the bump is disposed at one side of the cam proximal to the decelerator, the bump and the cam being of an integral structure.

13. The nail gun according to claim 7, wherein a lower end of the self-lock ejector pin is provided with a fitting portion fitted with the cam, the fitting portion having a big-end-down trapezoidal shape.

14. The nail gun according to claim 7, wherein the nail gun further comprises an Microcontroller Unit MCU and a selector switch that freely switches the nail gun between a single nail mode or a continuous nail mode, the selector switch being electrically connected to the MCU.

15. The nail gun according to claim 1, wherein the nail firing assembly further comprises a fixed seat, a nail exit base plate and a nail exit cover plate, wherein a lower end of the nail firing assembly is provided with a muzzle;

the nail gun further comprises a safety ejector pin assembly provided at the fixed seat side, wherein the safety ejector pin assembly comprises a safety switch and a safety ejector pill;

the nail supplying assembly comprises a guide rail plate, a movable guide rail fitted with the guide rail plate, a nail supplying block which presses against the nail, and a nail supplying elastic element for resetting the nail supplying block being provided between the movable guide rail and the nail supplying block;

on the nail exit base plate is provided a dry fire proof ejector pin; on the nail exit base plate is further provided a pin shaft penetrating through the dry file proof ejector pin; between the dry fire proof ejector pin and the nail supplying elastic element is provided an ejector block;

when there exist no nails inside the nail supplying assembly, the nail supplying elastic element presses against the ejector block, such that the ejector block presses against the dry fire proof ejector pin to axially limit the safety ejector pin to thereby prevent the safety ejector pin from contact-actuating the safety switch.

16. The nail gun according to claim 15, wherein on the movable guide rail is provided an accommodation groove for mounting the nail supplying elastic element;

a front end of the nail supplying elastic element is provided with an elastic element ejector block;

the elastic element ejector block is disposed within the accommodation groove;

the ejector block is movably disposed in the accommodation groove and provided at a front end of the elastic element ejector block;

a front end of the accommodation groove is provided with a limiting pin for limiting the ejector block;

the ejector block comprises a body, and a first push portion and a second push portion which are arranged in stagger, wherein the first push portion acts in cooperation with the dry fire proof ejector pin, and the second push portion acts in cooperation with the elastic element ejector block.

17. The nail gun according to claim 15, wherein the safety ejector pin assembly further comprises: a bushing support fixed on the fixed seat, a movable inner tube movably provided in the bushing support, and a connecting rod in connection with the movable inner tube;

wherein the connecting rod is connected to the safety ejector pin;

an upper end of the movable inner tube is provided with a contact-actuating frame that triggers the safety switch and moves along with the movable inner tube;

the safety ejector pin moves continuously along an axial direction of the movable inner tube so as to adjust an axial distance between a bottom end of the safety ejector pin and the muzzle.

* * * * *